US008777713B2

(12) United States Patent
Filipour et al.

(10) Patent No.: US 8,777,713 B2
(45) Date of Patent: Jul. 15, 2014

(54) GAMING SYSTEMS, GAMING DEVICES AND METHODS HAVING TIME BASED GAMES AND MAGNITUDES ASSOCIATED WITH WAGERING EVENTS IN THE TIME BASED GAMES

(75) Inventors: Cameron A. Filipour, Las Vegas, NV (US); Adam Singer, Las Vegas, NV (US); Alexander Popovich, Henderson, NV (US)

(73) Assignee: IGT, Las Vegas, NV (US)

( * ) Notice: Subject to any disclaimer, the term of this patent is extended or adjusted under 35 U.S.C. 154(b) by 1073 days.

(21) Appl. No.: 12/615,837

(22) Filed: Nov. 10, 2009

(65) Prior Publication Data

US 2011/0111820 A1 May 12, 2011

(51) Int. Cl.
*A63F 9/24* (2006.01)

(52) U.S. Cl.
USPC ..... 463/16; 463/20; 463/25

(58) Field of Classification Search
USPC ..... 463/16–20, 40–42
See application file for complete search history.

(56) References Cited

U.S. PATENT DOCUMENTS

| | | | |
|---|---|---|---|
| 6,012,983 | A | 1/2000 | Walker et al. |
| 6,077,163 | A | 6/2000 | Walker et al. |
| 6,179,711 | B1 | 1/2001 | Yoseloff |
| 6,203,430 | B1 | 3/2001 | Walker et al. |
| 6,312,334 | B1 | 11/2001 | Yoseloff |
| 6,328,649 | B1 | 12/2001 | Randall et al. |
| 6,454,651 | B1 | 9/2002 | Yoseloff |
| 6,471,208 | B2 | 10/2002 | Yoseloff et al. |
| 6,569,015 | B1 | 5/2003 | Baerlocher et al. |
| 6,634,942 | B2 | 10/2003 | Walker et al. |
| 6,638,164 | B2 | 10/2003 | Randall et al. |
| 6,645,075 | B1 | 11/2003 | Gatto et al. |
| 6,692,355 | B2 | 2/2004 | Baerlocher et al. |
| 6,726,565 | B2 | 4/2004 | Hughs-Baird |
| 6,796,904 | B2 | 9/2004 | Yoseloff |
| 6,964,611 | B2 | 11/2005 | Packes, Jr. et al. |
| 6,971,954 | B2 | 12/2005 | Randall et al. |
| 7,029,395 | B1 | 4/2006 | Baerlocher |
| 7,140,964 | B2 | 11/2006 | Walker et al. |
| 7,144,011 | B2 | 12/2006 | Asher et al. |

(Continued)

OTHER PUBLICATIONS

Letter from Marvin A. Motsenbocker of Mots Law dated Jan. 10, 2012 regarding Third Party Submission in Published Application Under 37 C.F.R. 1.99 filed for U.S. Appl. No. 12/774,048 (1 page).

(Continued)

*Primary Examiner* — Ronald Laneau
*Assistant Examiner* — Ross Williams
(74) *Attorney, Agent, or Firm* — Neal, Gerber & Eisenberg LLP

(57) ABSTRACT

A gaming system receives a total wager for a game session which occurs over a designated period of time. The game session includes a plurality of different wagering events. Each of the wagering events is associated with one of a plurality of different magnitudes. For each of the plurality of different wagering events, the gaming system determines: a portion of the total wager amount, and a wager by modifying the determined portion by the magnitude associated with that wagering event. The gaming system causes the wagering event to occur, determines at least one outcome for the wagering event, determines any awards based on the determined wager and the at least one determined outcome, and provides any of the determined awards to the player.

19 Claims, 23 Drawing Sheets

(56) References Cited

U.S. PATENT DOCUMENTS

| | | | | |
|---|---|---|---|---|
| 7,247,092 | B2 | 7/2007 | Jarvis et al. | |
| 7,250,001 | B2 | 7/2007 | Baerlocher et al. | |
| 7,258,611 | B2 | 8/2007 | Bigelow, Jr. et al. | |
| 7,306,518 | B2 | 12/2007 | Hughs-Baird et al. | |
| 7,326,115 | B2 | 2/2008 | Baerlocher | |
| 7,329,179 | B2 | 2/2008 | Baerlocher | |
| 7,331,863 | B2 | 2/2008 | Baerlocher | |
| 7,338,370 | B2 | 3/2008 | Oles et al. | |
| 7,351,146 | B2 | 4/2008 | Kaminkow | |
| 7,387,570 | B2 | 6/2008 | Randall | |
| 7,465,227 | B2 | 12/2008 | Baerlocher | |
| 7,470,185 | B2 | 12/2008 | Baerlocher | |
| 7,488,247 | B2 | 2/2009 | Hughs-Baird et al. | |
| 7,488,248 | B2 | 2/2009 | Hughs-Baird et al. | |
| 7,488,249 | B2 | 2/2009 | Hughs-Baird et al. | |
| 7,488,251 | B2 | 2/2009 | Kaminkow | |
| 8,075,396 | B2 | 12/2011 | Roemer | |
| 2003/0114217 | A1 | 6/2003 | Walker et al. | |
| 2003/0144053 | A1 | 7/2003 | Michaelson | |
| 2003/0236115 | A1 | 12/2003 | Chamberlain | |
| 2004/0063492 | A1 | 4/2004 | Baerlocher et al. | |
| 2004/0102238 | A1 | 5/2004 | Taylor | |
| 2004/0106449 | A1 | 6/2004 | Walker et al. | |
| 2004/0147308 | A1 | 7/2004 | Walker et al. | |
| 2004/0162130 | A1 | 8/2004 | Walker et al. | |
| 2004/0162134 | A1 | 8/2004 | Walker et al. | |
| 2004/0171419 | A1 | 9/2004 | Walker et al. | |
| 2004/0204218 | A1 | 10/2004 | Hughs-Baird | |
| 2004/0204229 | A1* | 10/2004 | Walker et al. | 463/20 |
| 2004/0219969 | A1* | 11/2004 | Casey et al. | 463/20 |
| 2004/0259625 | A1 | 12/2004 | Randall | |
| 2005/0037839 | A1 | 2/2005 | Yoseloff | |
| 2005/0054416 | A1 | 3/2005 | Hostetler et al. | |
| 2005/0054429 | A1 | 3/2005 | Baerlocher et al. | |
| 2005/0060050 | A1 | 3/2005 | Baerlocher | |
| 2005/0085295 | A1 | 4/2005 | Walker et al. | |
| 2005/0170876 | A1 | 8/2005 | Masci et al. | |
| 2005/0282625 | A1 | 12/2005 | Nicely | |
| 2006/0030399 | A1 | 2/2006 | Baerlocher | |
| 2006/0035697 | A1 | 2/2006 | Packes et al. | |
| 2006/0040730 | A1 | 2/2006 | Walker et al. | |
| 2006/0046835 | A1 | 3/2006 | Walker et al. | |
| 2006/0046836 | A1 | 3/2006 | Walker et al. | |
| 2006/0068903 | A1 | 3/2006 | Walker et al. | |
| 2006/0079321 | A1 | 4/2006 | Walker et al. | |
| 2006/0084501 | A1 | 4/2006 | Walker et al. | |
| 2006/0089195 | A1 | 4/2006 | Walker et al. | |
| 2006/0105837 | A1 | 5/2006 | Walker et al. | |
| 2006/0128457 | A1 | 6/2006 | Cannon | |
| 2006/0142077 | A1 | 6/2006 | Miles et al. | |
| 2007/0004503 | A1 | 1/2007 | Walker et al. | |
| 2007/0254732 | A1 | 11/2007 | Walker et al. | |
| 2007/0265063 | A1 | 11/2007 | McNally | |
| 2007/0281778 | A1 | 12/2007 | Bigelow, Jr. et al. | |
| 2008/0102934 | A1 | 5/2008 | Tan | |
| 2008/0108406 | A1 | 5/2008 | Oberberger | |
| 2008/0108425 | A1 | 5/2008 | Oberberger | |
| 2008/0113759 | A1 | 5/2008 | Baerlocher | |
| 2008/0119283 | A1 | 5/2008 | Baerlocher | |
| 2008/0132320 | A1 | 6/2008 | Rodgers | |
| 2008/0132325 | A1 | 6/2008 | Oles et al. | |
| 2008/0139272 | A1 | 6/2008 | Toyoda | |
| 2008/0153584 | A1 | 6/2008 | Cuddy et al. | |
| 2008/0182650 | A1 | 7/2008 | Randall et al. | |
| 2008/0182655 | A1 | 7/2008 | DeWaal et al. | |
| 2008/0194316 | A1 | 8/2008 | Baerlocher | |
| 2008/0214255 | A1 | 9/2008 | Jarvis et al. | |
| 2008/0214280 | A1 | 9/2008 | Baerlocher | |
| 2008/0268946 | A1 | 10/2008 | Roemer | |
| 2008/0300050 | A1 | 12/2008 | Tessmer et al. | |
| 2008/0318656 | A1 | 12/2008 | Walker et al. | |
| 2008/0318668 | A1 | 12/2008 | Ching et al. | |
| 2009/0017900 | A1 | 1/2009 | Fujimoto et al. | |
| 2009/0042638 | A1* | 2/2009 | Thomas | 463/20 |
| 2009/0061991 | A1 | 3/2009 | Popovich et al. | |
| 2009/0061997 | A1 | 3/2009 | Popovich et al. | |
| 2009/0061998 | A1 | 3/2009 | Popovich et al. | |
| 2009/0061999 | A1 | 3/2009 | Popovich et al. | |
| 2009/0068073 | A1 | 3/2009 | Anselmo et al. | |
| 2009/0088253 | A1 | 4/2009 | Oberberger et al. | |
| 2009/0104959 | A1 | 4/2009 | Caputo et al. | |
| 2009/0104977 | A1 | 4/2009 | Zielinski | |
| 2009/0111573 | A1 | 4/2009 | Iddings | |
| 2009/0117962 | A1 | 5/2009 | Filipour et al. | |
| 2009/0124326 | A1 | 5/2009 | Caputo et al. | |
| 2009/0131158 | A1 | 5/2009 | Brunet de Courssou et al. | |
| 2009/0143133 | A1 | 6/2009 | Baerlocher | |
| 2009/0170588 | A1 | 7/2009 | Baerlocher | |
| 2009/0253492 | A1 | 10/2009 | Caputo et al. | |

OTHER PUBLICATIONS

Third Party Submission in Published Application Under 37 C.F.R. 1.99 filed for U.S. Appl. No. 12/774,048, dated Jan. 10, 2012 (3 pages).

Partially-highlighted U.S. Patent Appl. Pub. No. 2008/0139272 submitted with Third Party Submission in Published Application Under 37 C.F.R. 1.99 for U.S. Appl. No. 12/774,048 (1 page).

Partially-highlighted U.S. Patent Appl. Pub. No. 2009/0017900 submitted with Third Party Submission in Published Application Under 37 C.F.R. 1.99 for U.S. Appl. No. 12/774,048 (1 page).

Letter from Marvin A. Motsenbocker of Mots Law dated Jul. 8, 2011 regarding Third Party Submission in Published Application Under 37 C.F.R. 1.99 filed for U.S. Appl. No. 12/615,837 (1 pages).

Third Party Submission in Published Application Under 37 C.F.R. 1.99 filed for U.S. Appl. No. 12/615,837, dated Jul. 8, 2011 (3 pages).

Office Action for U.S. Appl. No. 12/774,048 dated Mar. 2, 2012 (5 pages).

* cited by examiner

FIG. 4

| | 62 WAGERING EVENTS | 64 MAGNITUDES | |
|---|---|---|---|
| 62a | Bank Robbery | 1.0 | 64a |
| 62b | Rob Jewelry Store | 0.9 | 64b |
| 62c | Rob Bootlegger | 0.8 | 64c |
| 62d | Car Theft | 0.7 | 64d |
| 62e | Mugging | 0.2 | 64e |
| 62f | Rob Truck Driver | 0.9 | 64f |

FIG. 7

94 110a 110b 110c 110d

| | WAGERING EVENTS | MAGNITUDE FIRST QUARTER | MAGNITUDE SECOND QUARTER | MAGNITUDE THIRD QUARTER | MAGNITUDE FOURTH QUARTER |
|---|---|---|---|---|---|
| 64a | Bank Robbery | 1.0 | 0.95 | 0.95 | 1.0 |
| 64b | Rob Jewelry Store | 0.9 | 0.85 | 0.85 | 0.9 |
| 64c | Rob Bootlegger | 0.85 | 0.8 | 0.8 | 0.85 |
| 64d | Car Theft | 0.7 | 0.6 | 0.6 | 0.7 |
| 64e | Mugging | 0.2 | 0.15 | 0.15 | 0.2 |

FIG. 8

96

| | WAGERING EVENTS | MAGNITUDE RANGE |
|---|---|---|
| 64a | Bank Robbery | 1.0 - 0.9 |
| 64b | Rob Jewelry Store | 0.9 - 0.8 |
| 64c | Rob Bootlegger | 0.85 - 0.75 |
| 64d | Car Theft | 0.7 - 0.5 |
| 64e | Mugging | 0.2 - 0.15 |

GAMING SYSTEMS, GAMING DEVICES AND METHODS HAVING TIME BASED GAMES AND MAGNITUDES ASSOCIATED WITH WAGERING EVENTS IN THE TIME BASED GAMES

CROSS REFERENCE TO RELATED APPLICATION

This application is related to the following commonly-owned co-pending U.S. patent application: U.S. patent application Ser. No. 12/774,048, entitled GAMING SYSTEMS, GAMING DEVICES AND METHODS PROVIDING TIME BASED GAME SESSIONS WITH CHANGING VALUES, filed on May 5, 2010.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming devices that enable a player to place a wager for a game session over a designated period of time are known. These known game sessions typically include a number of events in which, for each event, the gaming system determines a wager for the event based on an amount of time elapsed since the beginning of the event or since a previous event. These known gaming devices take into account time between each event, but not the events themselves. One drawback of such known gaming devices is that they treat all events equally, applying all of the accrued amounts between wagering events to the next wagering event without taking into account what the wagering events are.

There is a continuing need to provide new and different gaming systems, gaming devices and methods which enable a player to place a wager for a game session which occurs over a designated period of time.

SUMMARY

Various embodiments of the present disclosure are generally directed to gaming systems, gaming devices and methods that enable a player to place a total wager for a game session which occurs over a designated period of time during which a plurality of different wagering events can occur. Each wagering event includes a play of a game with an at least partially randomly determined outcome, or another event with an at least partially randomly determined outcome. Two or more of the different wagering events are associated with a plurality of different magnitudes. For each of the plurality of different wagering events during the game session, the gaming system determines a portion of the total wager for that wagering event and determines a wager for the wagering event by modifying that portion by the magnitude associated with that wagering event. The portion of the total wager is based at least in part on the time since the previous wagering event or in the case of the first wagering event, since the start of the game session. The gaming system causes the wagering event to occur, determines and displays at least one outcome for the wagering event, determines any awards for the wagering event based at least in part on the at least one determined outcome and the determined wager for that wagering event, and provides any determined awards to the player.

In other embodiments, for a plurality of different wagering events, the gaming system associates one of a plurality of different groups (such as ranges) of magnitudes with that wagering event. For each of the plurality of different wagering events, the gaming system determines a portion of the total wager for that wagering event, determines a magnitude from the group (such as ranges) of magnitudes for that wagering event, and determines a wager for that wagering event by modifying the determined portion by the determined magnitude, causes the wagering event to occur, determines and displays at least one outcome for the wagering event, determines any awards based at least in part on the at least one determined outcome and the determined wager for that wagering event, and provides any determined awards to the player.

In other embodiments, for a plurality of different wagering events, the gaming system associates one of a plurality of different magnitudes with that wagering event. Each of the plurality of different magnitudes correspond to a particular time period during the game session. For each of the plurality of different wagering events, the gaming system determines a portion of the total wager for that wagering event, determines the time period for said wagering event, selects the magnitude from the plurality of magnitudes corresponding to the determined time period, determines a wager for the wagering event by modifying the determined portion by the selected magnitude, causes the wagering event to occur, determines and displays at least one outcome for the wagering event, determines any awards based at least in part on the at least one determined outcome and the determined wager, and provides any determined award to the player.

In various embodiments, the at least one determined outcome for each wagering event includes a first outcome and a second outcome. The gaming system determines the first outcome based at least in part on one or more player inputs that require skill and determines the second outcome based at least in part on one or more random determinations. The gaming system determines a first award associated with the first outcome (such as number of points). The gaming system determines a second award associated with the randomly determined second outcome and determined portion of the total wager (such as a number of credits). In one embodiment, the gaming system displays both the first outcome and the second outcome.

The gaming system disclosed herein is configured to provide a game session as a wagering primary or base game. In other embodiments, the gaming system disclosed herein is configured to provide a game session as a secondary or bonus game, wherein the initial wager is provided by the gaming system.

Additional features and advantages are described in, and will be apparent from, the following Detailed Description and the figures.

BRIEF DESCRIPTION OF THE FIGURES

FIG. 4 is a table showing the magnitudes associated with each wagering event in the example embodiment of FIGS. 4A, 4B, 4C, 4D, 4E, 4F, 4G, 4H, 4I, 4J, 4K 4L, 4M, 4N and 4O.

FIG. 7 is a table showing an embodiment of a game session in which the gaming system associates a plurality of different magnitudes with each wagering event and in which each of the magnitudes correspond to a particular time period during which one of the wagering events occurs.

FIG. 8 is a table showing an embodiment of a game session in which the gaming system assigns a range of magnitudes to each wagering event

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
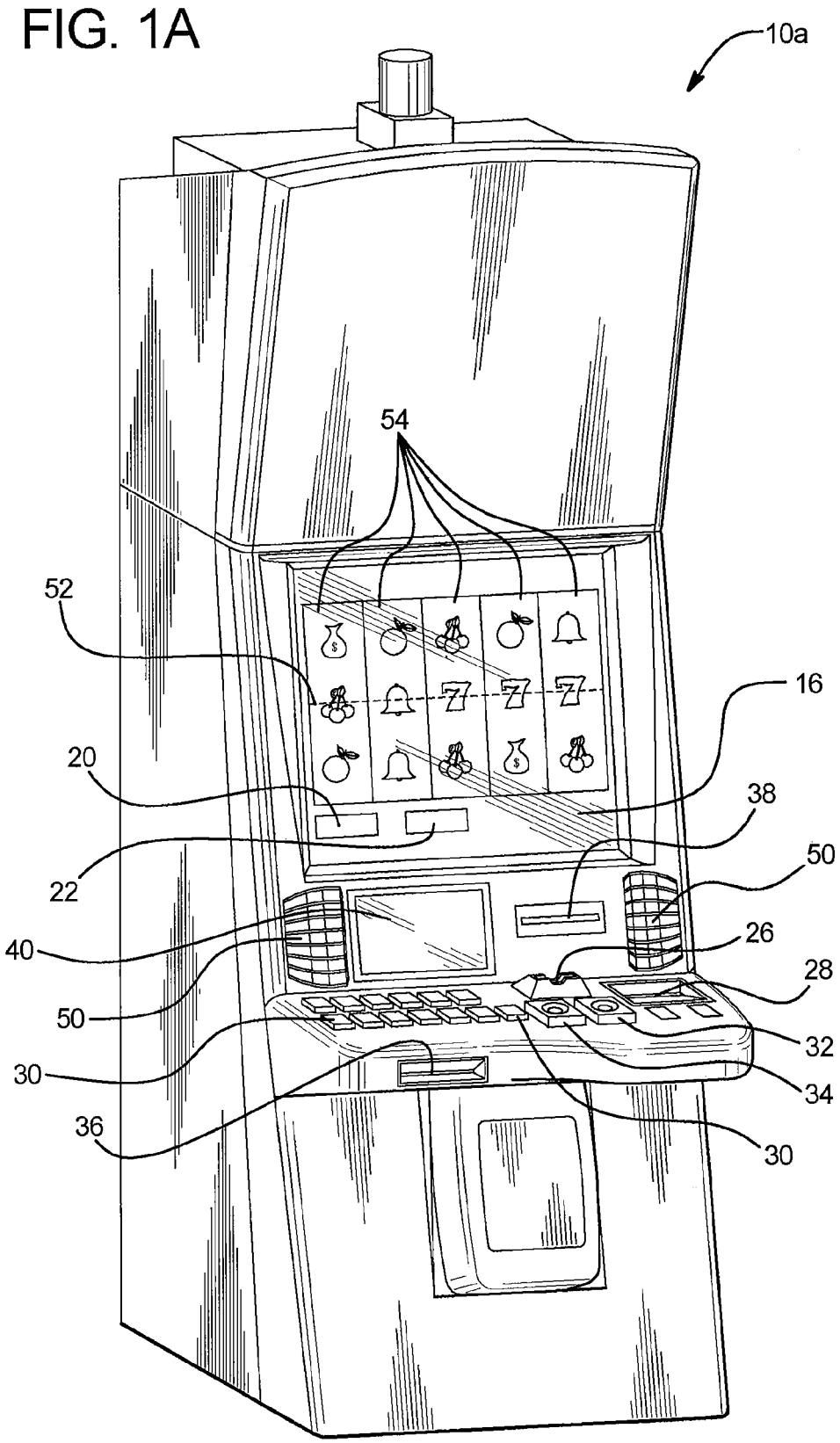
FIGS. 1A and 1B are perspective views of example alternative embodiments of the gaming device of the present disclosure.
Figure 1B:
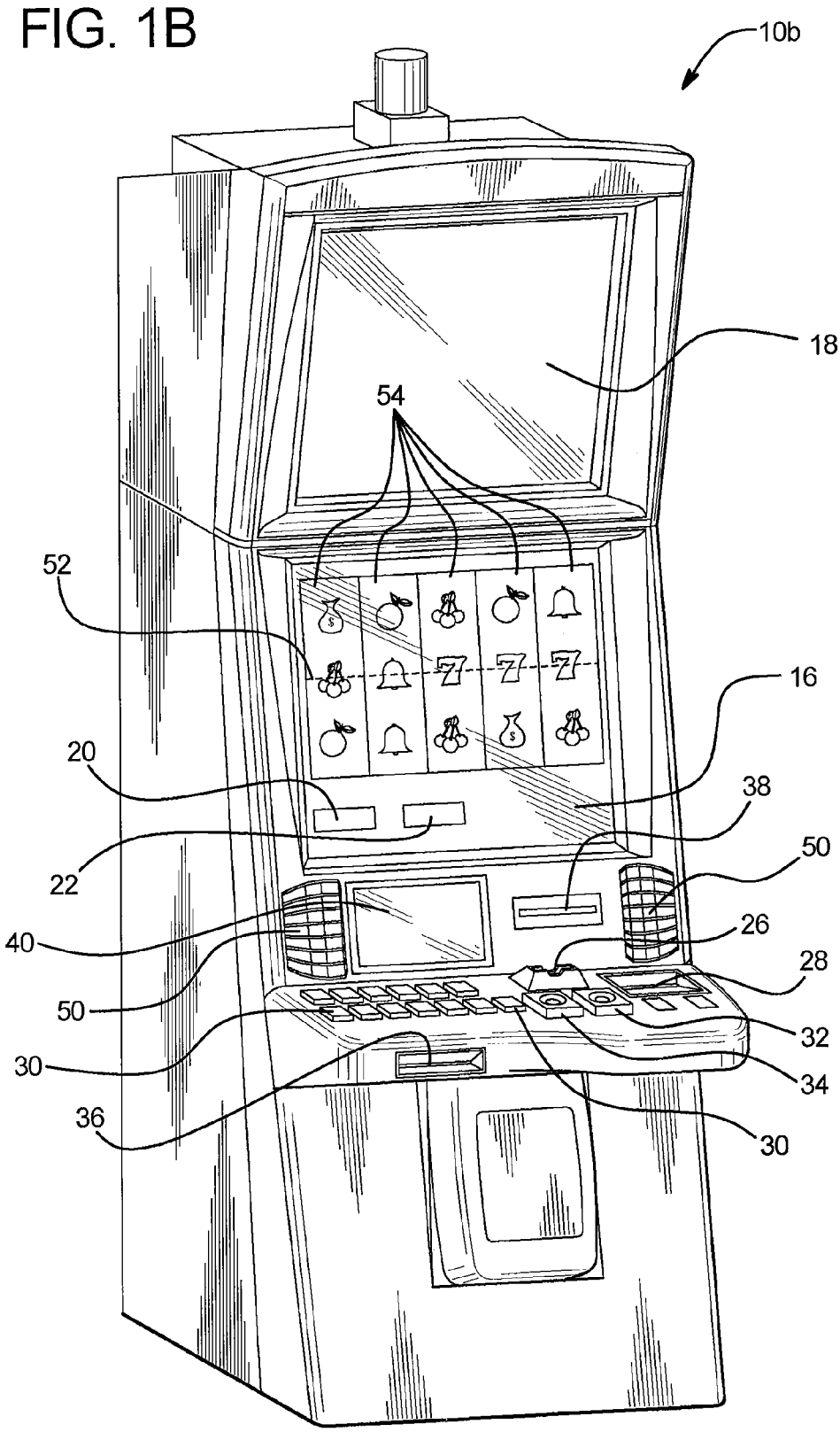

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
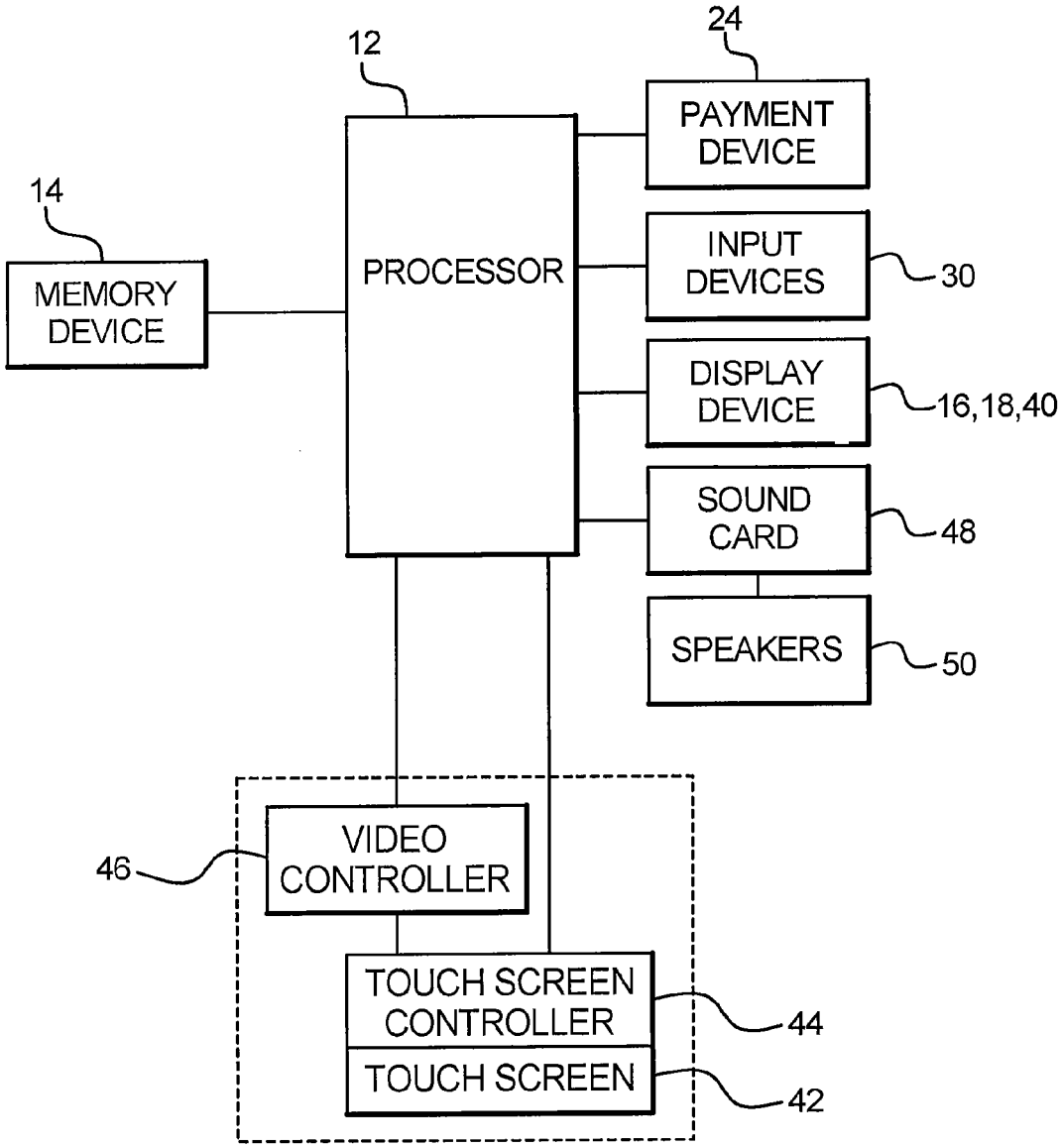
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-scren controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

In the present disclosure, the wagering event can be a primary game or a secondary game. Where the wagering event is a primary game, the random determination can be accomplished in any suitable manner. For instance, the random determination can be suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. If the wagering event is a secondary game, the random determination can be accomplished in any suitable manner such as described in the primary game.

In one embodiment, as illustrated in FIGS. 1A and 1B, the wagering event may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the wagering event stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a wagering event may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the wagering event may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the wagering event may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a wagering event, the gaming device may also give players the opportunity to win credits in the bonus or secondary game or in a bonus or secondary round. The bonus or secondary game enables the player to obtain a prize or payout in addition to the prize or payout, if any, obtained from the wagering event game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
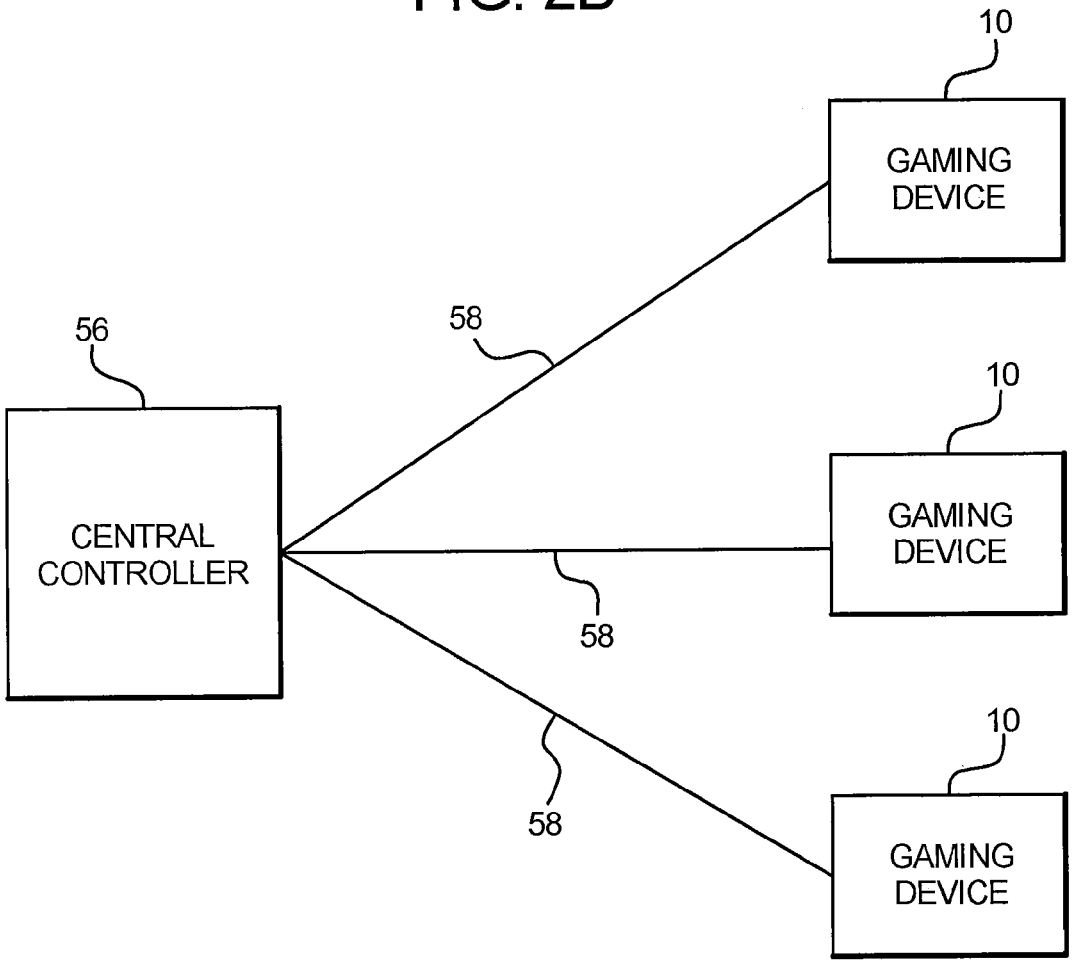
FIG. 2B is a schematic block diagram of one embodiment of a gaming system network configuration including a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device.

In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an Internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an Internet game page from any location where an Internet connection and computer or other internet facilitator is availble. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more, of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Time Based Wagering Events with Different Magnitudes

Various embodiments of the present disclosure are generally directed to gaming systems, gaming devices and methods that enable a player to place a total wager for a game session which occurs over a designated period of time in which a plurality of different wagering events can occur. In various different embodiments, for each of a plurality of the different wagering events, the gaming system associates a different magnitude, a plurality of magnitudes, or a group such as a range of magnitudes with such wagering event. For each of the plurality of the different wagering events, the gaming system determines a portion of the total wager for the wagering event.

In various embodiments, the gaming system determines the portion of the total wager based on the time since a previous wagering event, or if it is the first wagering event, the time since the beginning of the game session. In various other embodiments, gaming system determines the portion of the total wager based on an amount or component of an initial total wager that was selected to be wagered on each wagering event that occurs during the game session (i.e., a wager component).

In various embodiments, the at least one determined outcome includes a first outcome (such as a points outcome) and a second outcome (such as a credits outcome) as described in further detail herein. The gaming system determines the first outcome based at least in part on one or more player inputs that require skill and determines the second outcome based at least in part on one or more random determinations. The gaming system determines an award associated with the first outcome (such as number of points) and determines an award associated with the second outcome (such as a number of credits).

Figure 3:
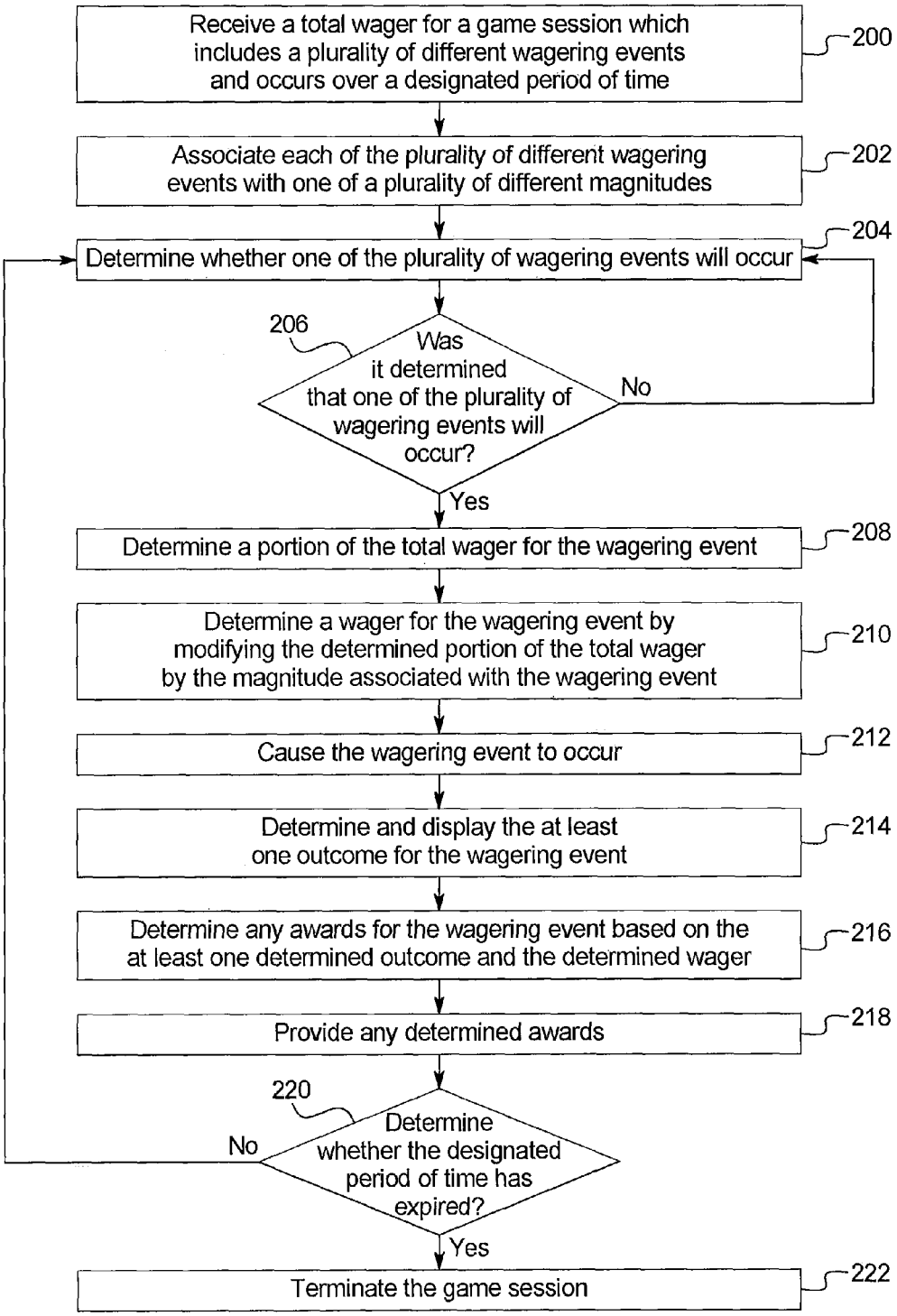
FIG. 3 is a flowchart of one example embodiment of the gaming system disclosed herein which enables a player to place a total wager for a game session over a designated period of time.

Referring now to the Figures, FIG. 3 is a flowchart illustrating one such embodiment of a gaming system configured to enable a player to place a total wager for a game session which occurs over a designated period of time. The gaming system receives a total wager for a game session which will include a plurality of different wagering events and which will occur over a designated period of time as indicated by block 200. The gaming system associates each of the plurality of different wagering events with one of a plurality of different magnitudes as indicated by block 202. The gaming system determines whether one of the plurality of wagering events will occur as indicated by block 204. The gaming system determines if one of the plurality of different wagering events was determined to occur as indicated by diamond 206. If the determination is that one of the plurality of different wagering events will occur, the gaming system determines a portion of the total wager for the wagering event as indicated by block 208. The gaming system determines a wager for the wagering event by modifying the determined portion of the total wager by the magnitude associated with the wagering event as indicated by block 210. The gaming system causes the wagering event to occur as indicated by block 212. The gaming system determines and displays at least one outcome associated with the wagering event as indicated by block 214. The gaming system determines any awards based on the at least one determined outcome and the determined wager as indicated by block 216. The gaming system provides any determined awards to the player as indicated by block 218. The gaming system determines if the designated period of time for the game session has expired as indicated by diamond 220. If the determination is that the designated period of time has expired, the gaming system terminates the game session, as indicated by block 222. If the determination is that the designated period of time has not expired, the gaming system determines whether one of the plurality of wagering events will occur as indicated by block 222. It should be appreciated that in various embodiments, the determination of the portion of the total wager for the wagering event occurs after the gaming system causes the wagering event to occur.

Figure 5A:
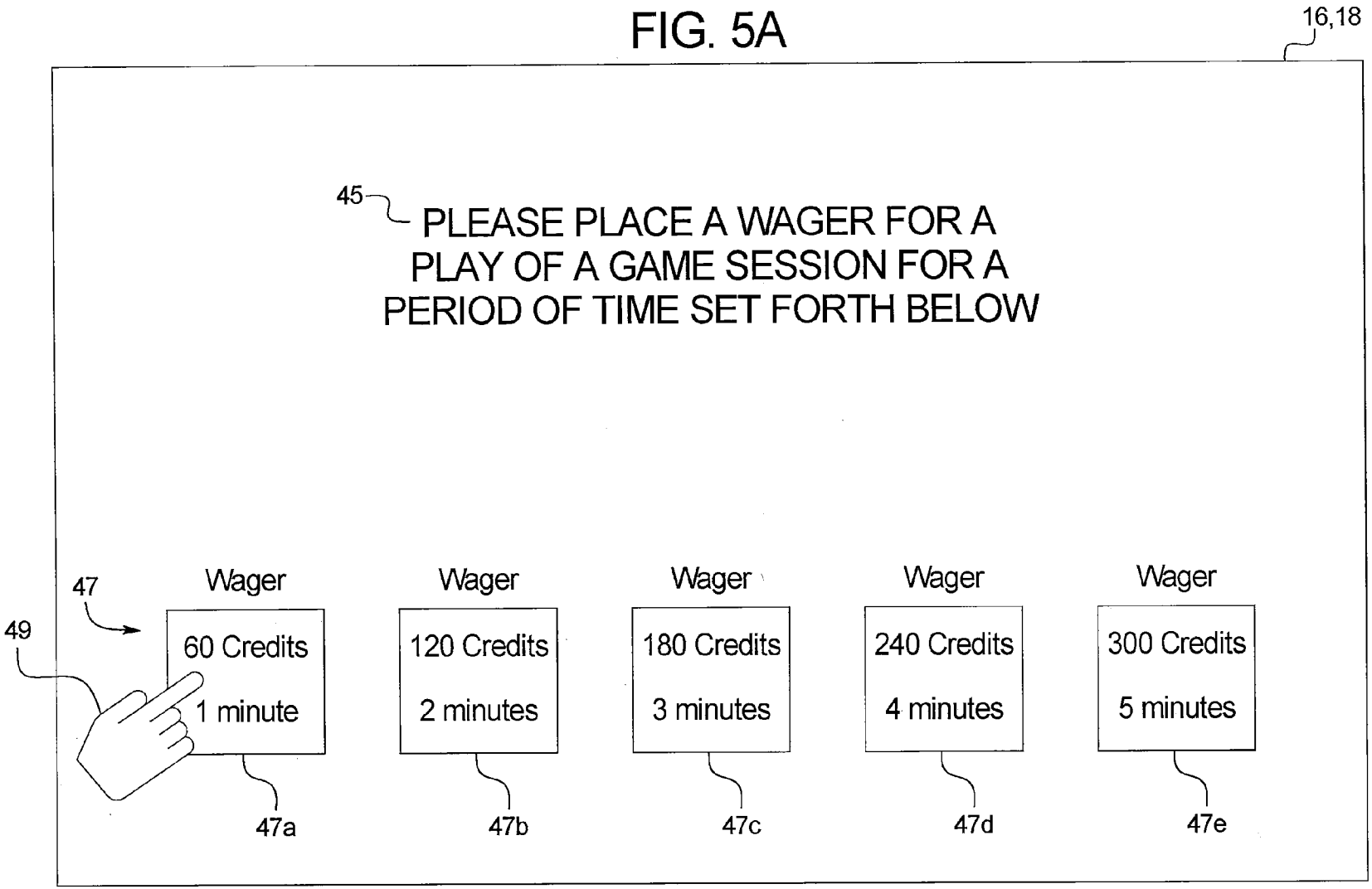
FIGS. 5A, 5B, 5C, 5D, 5E, 5F, 5G, 5H, 5I, 5J, 5K, 5L, 5M, 5N and 5O are front views of a gaming device display enabling a play of a game session in accordance with an example of an embodiment of the gaming device disclosed herein.
Figure 5B:
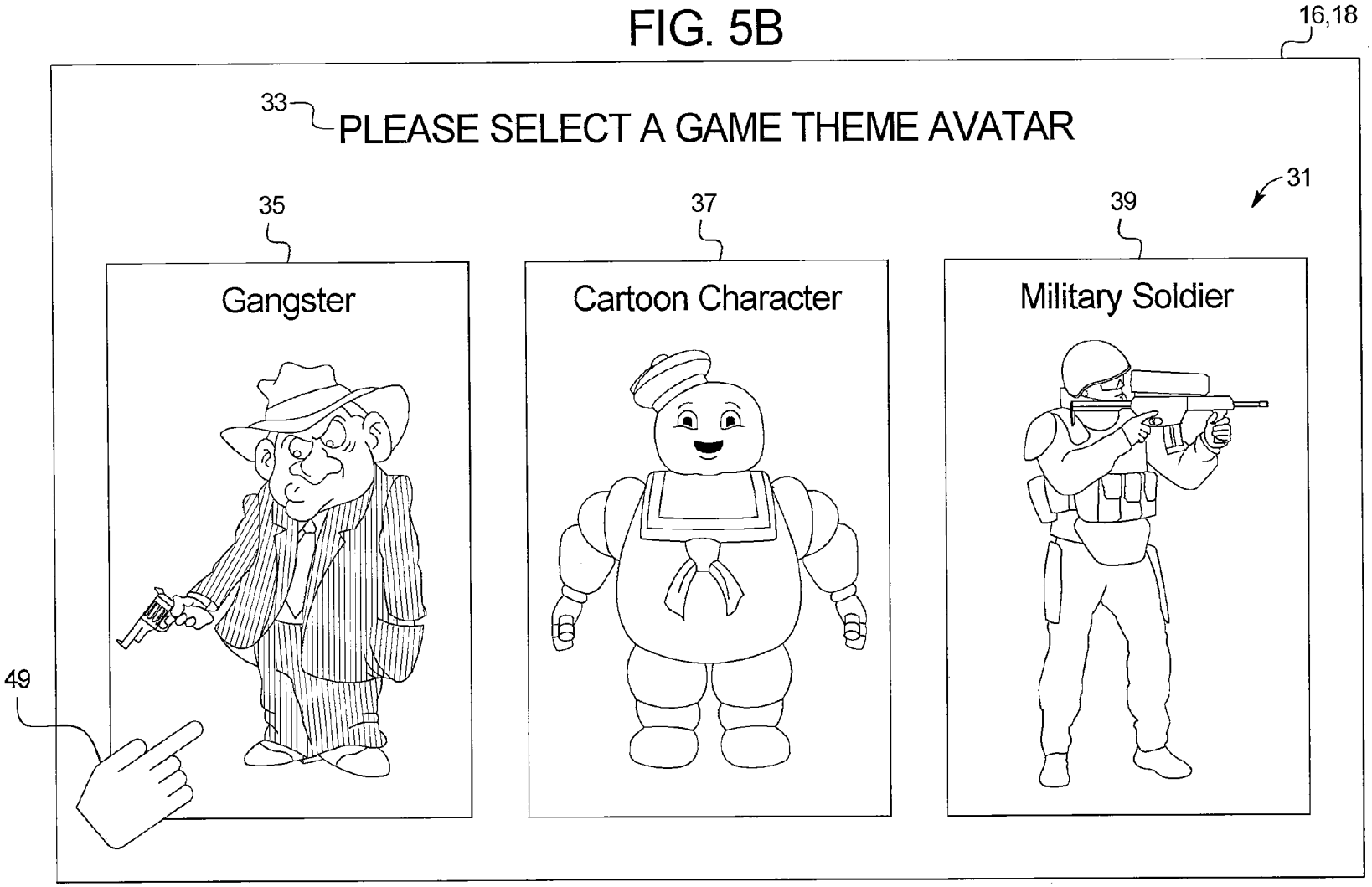
Figure 5C:
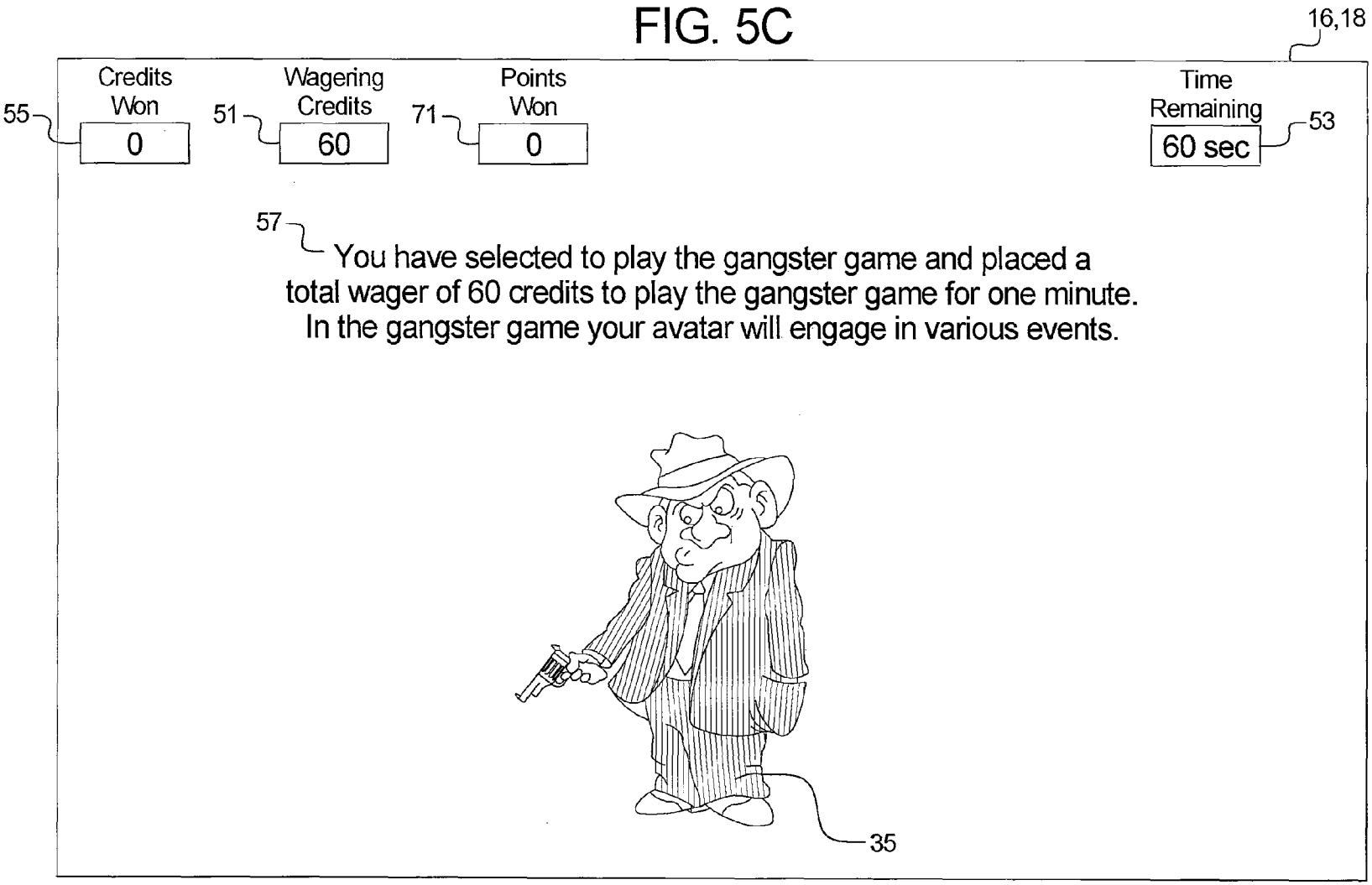
Figure 5D:
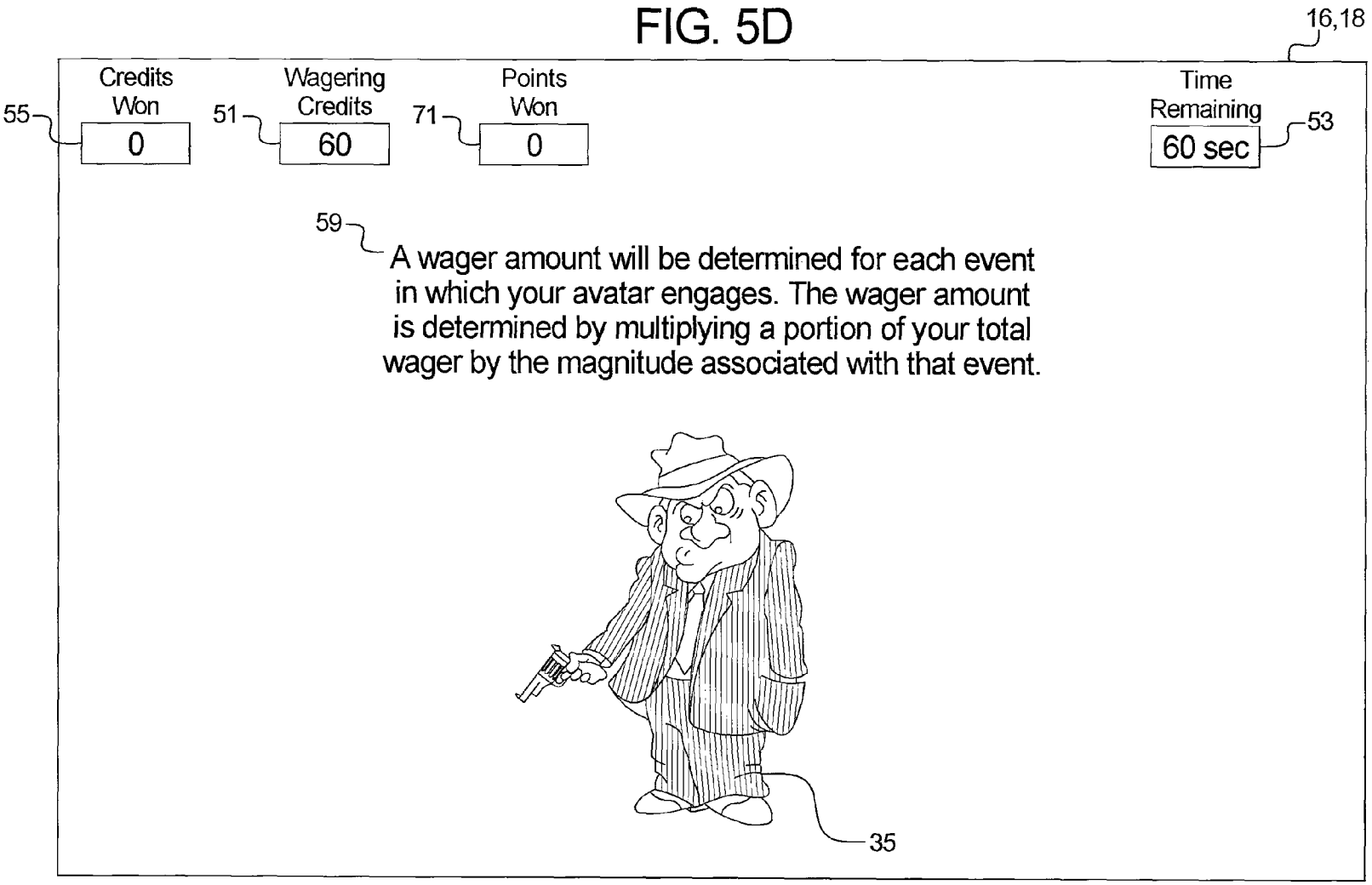
Figure 5E:
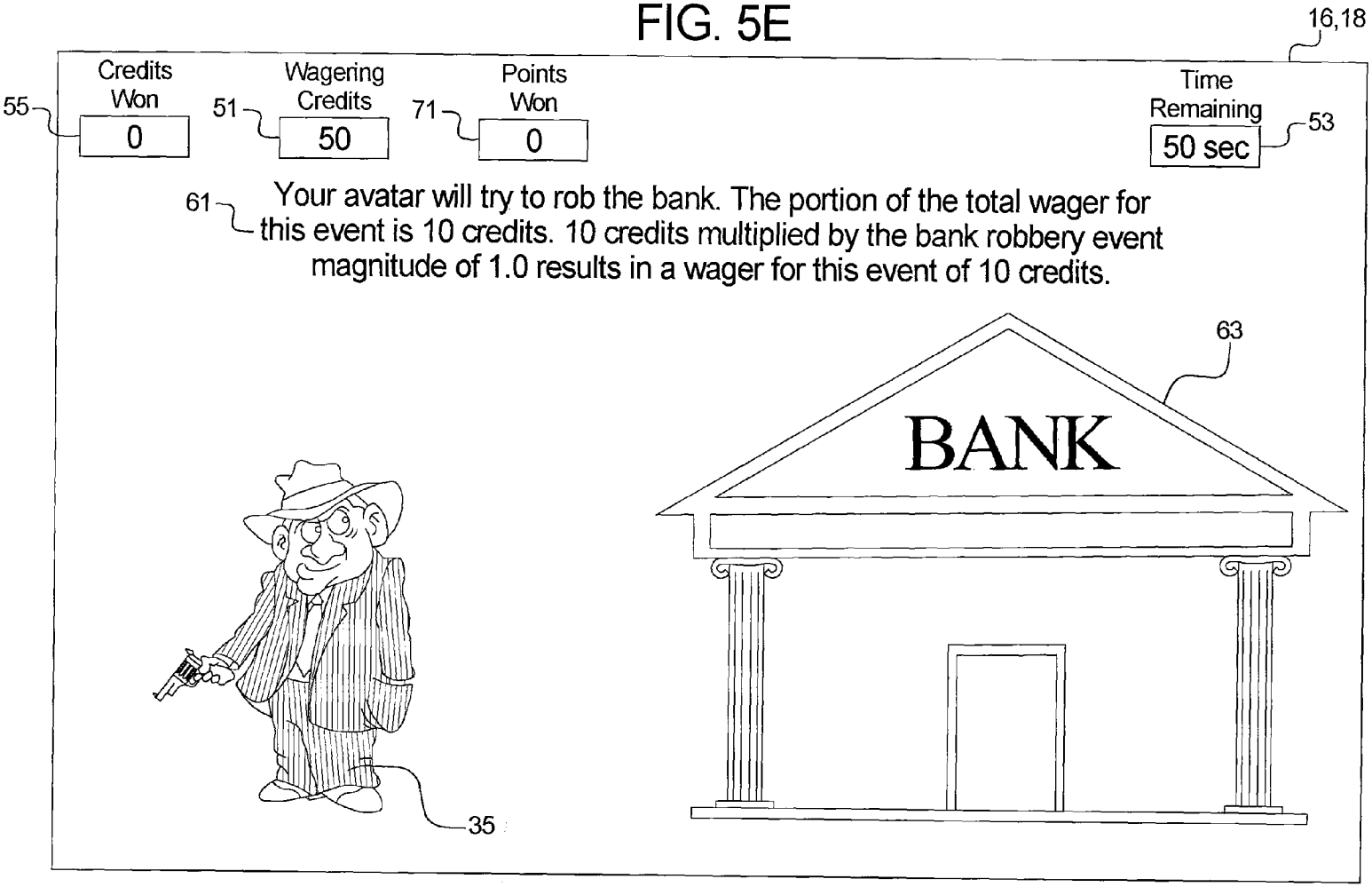
Figure 5F:
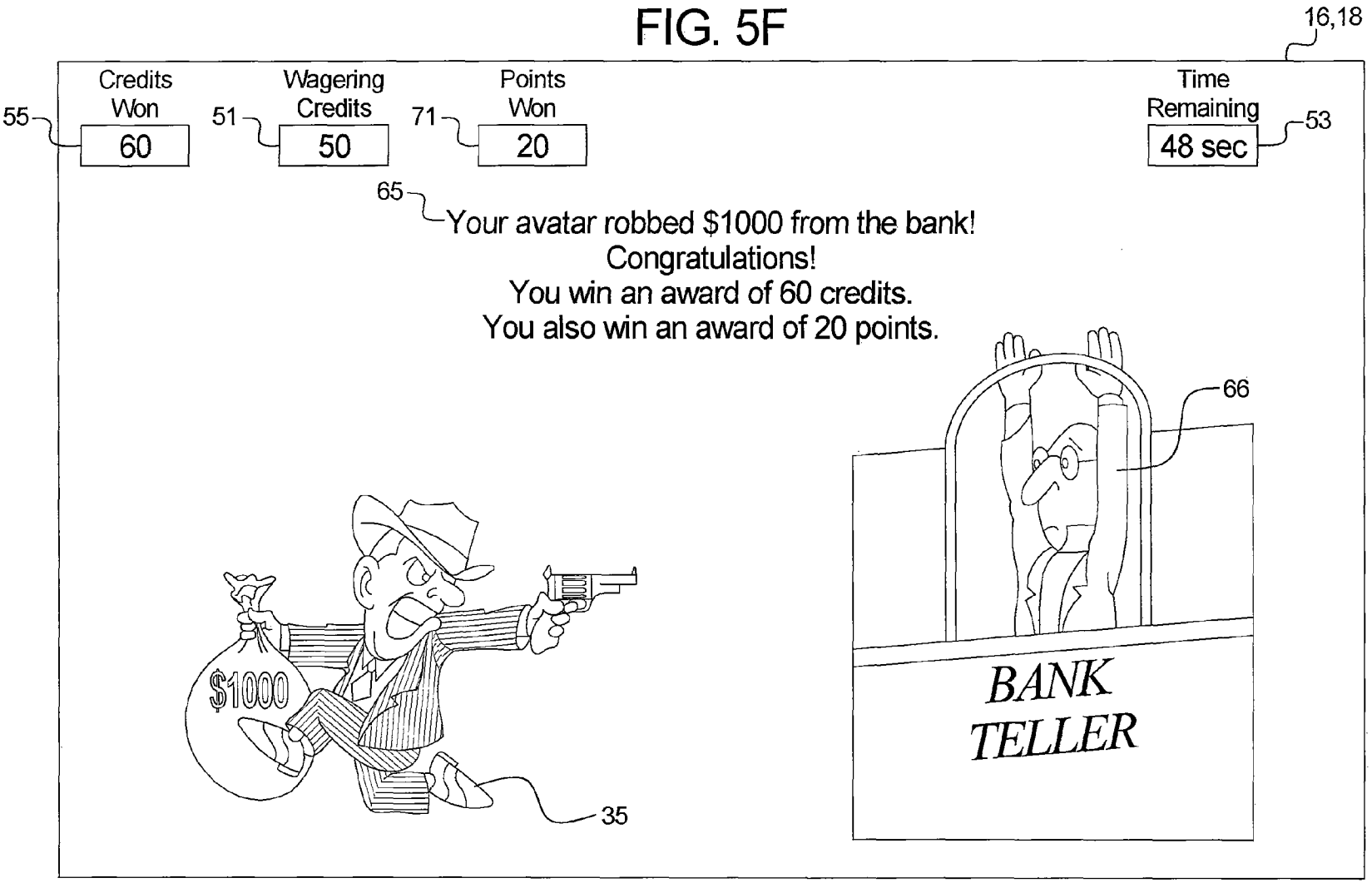
Figure 5G:
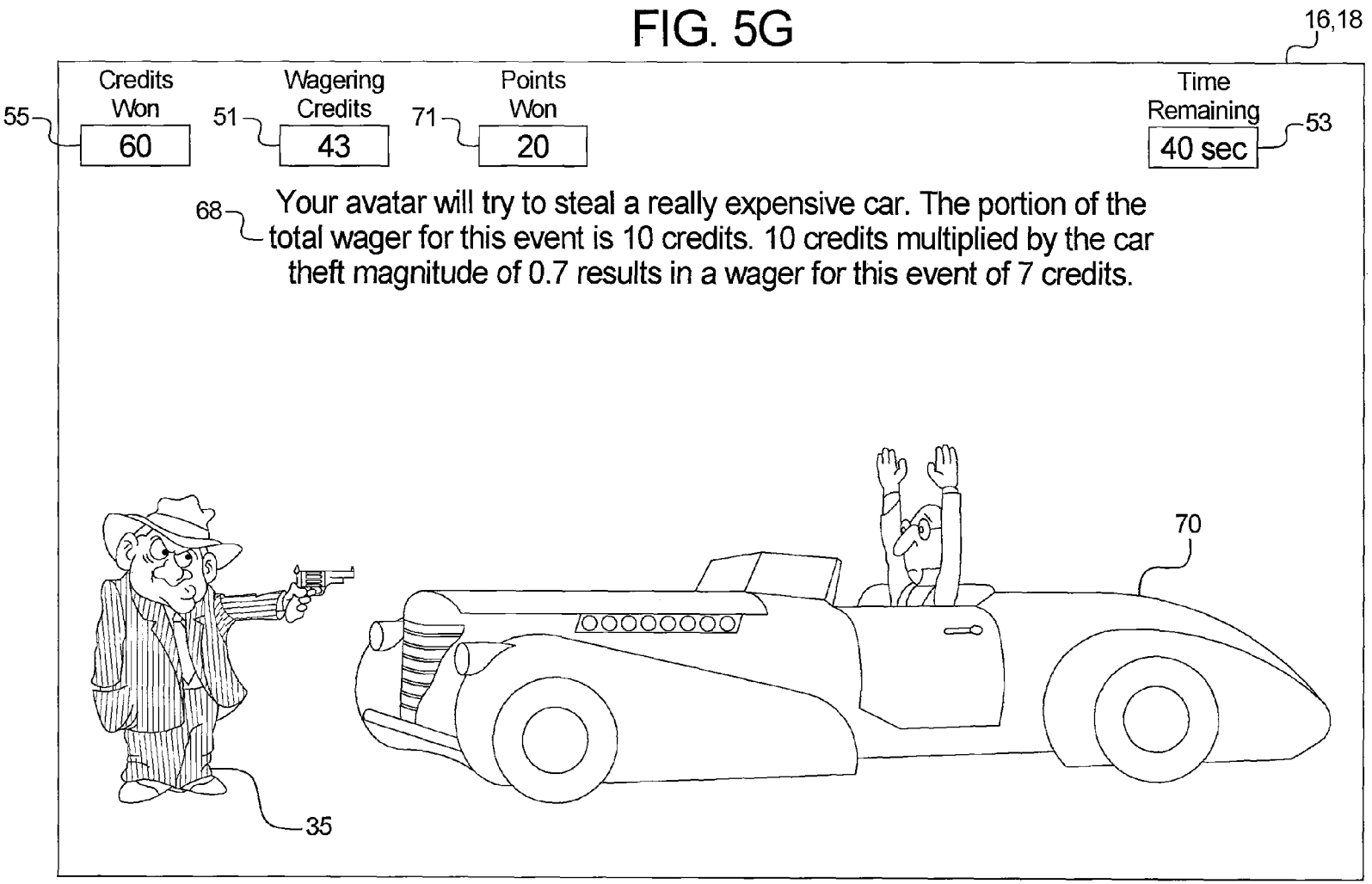
Figure 5H:
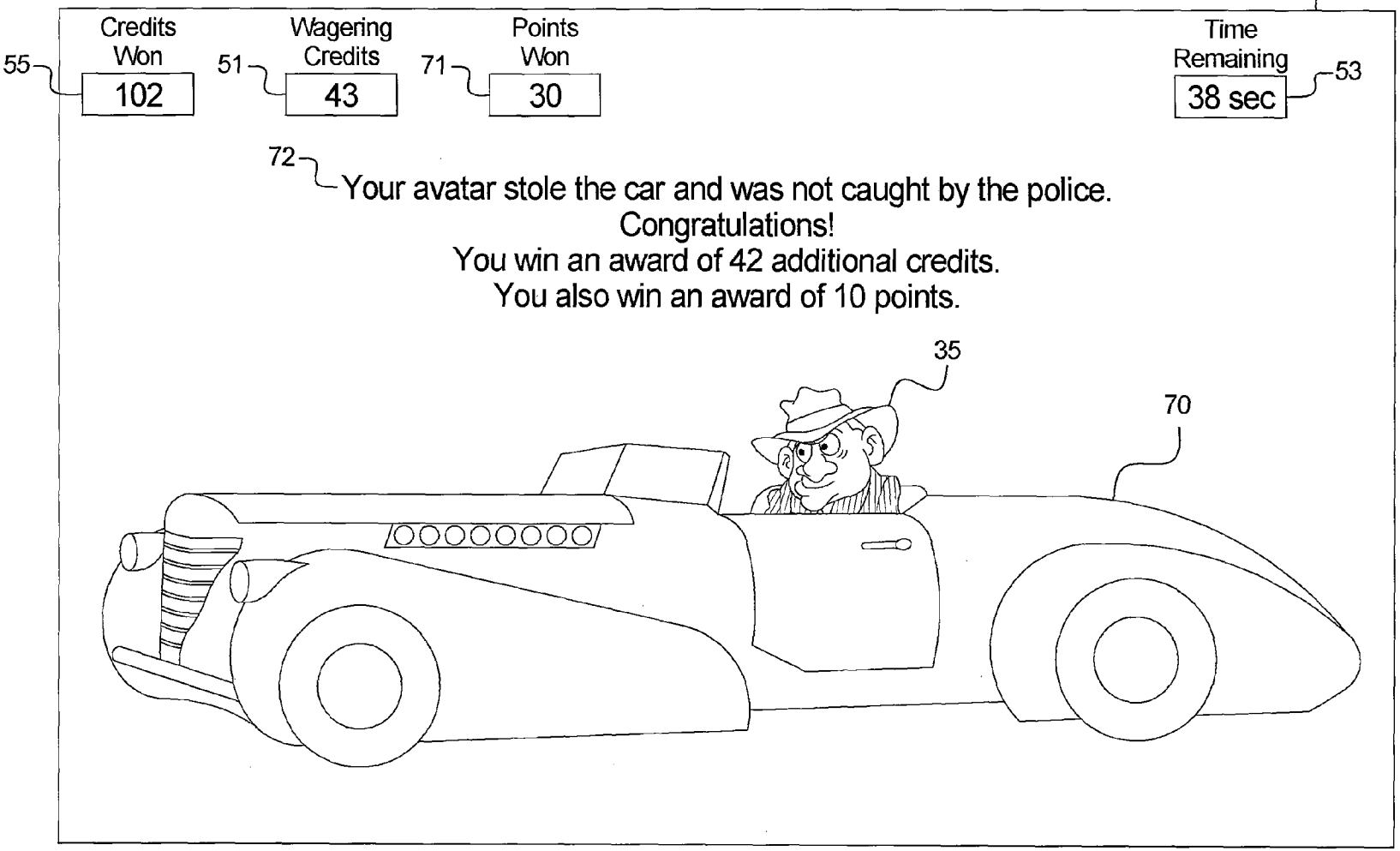
Figure 5I:
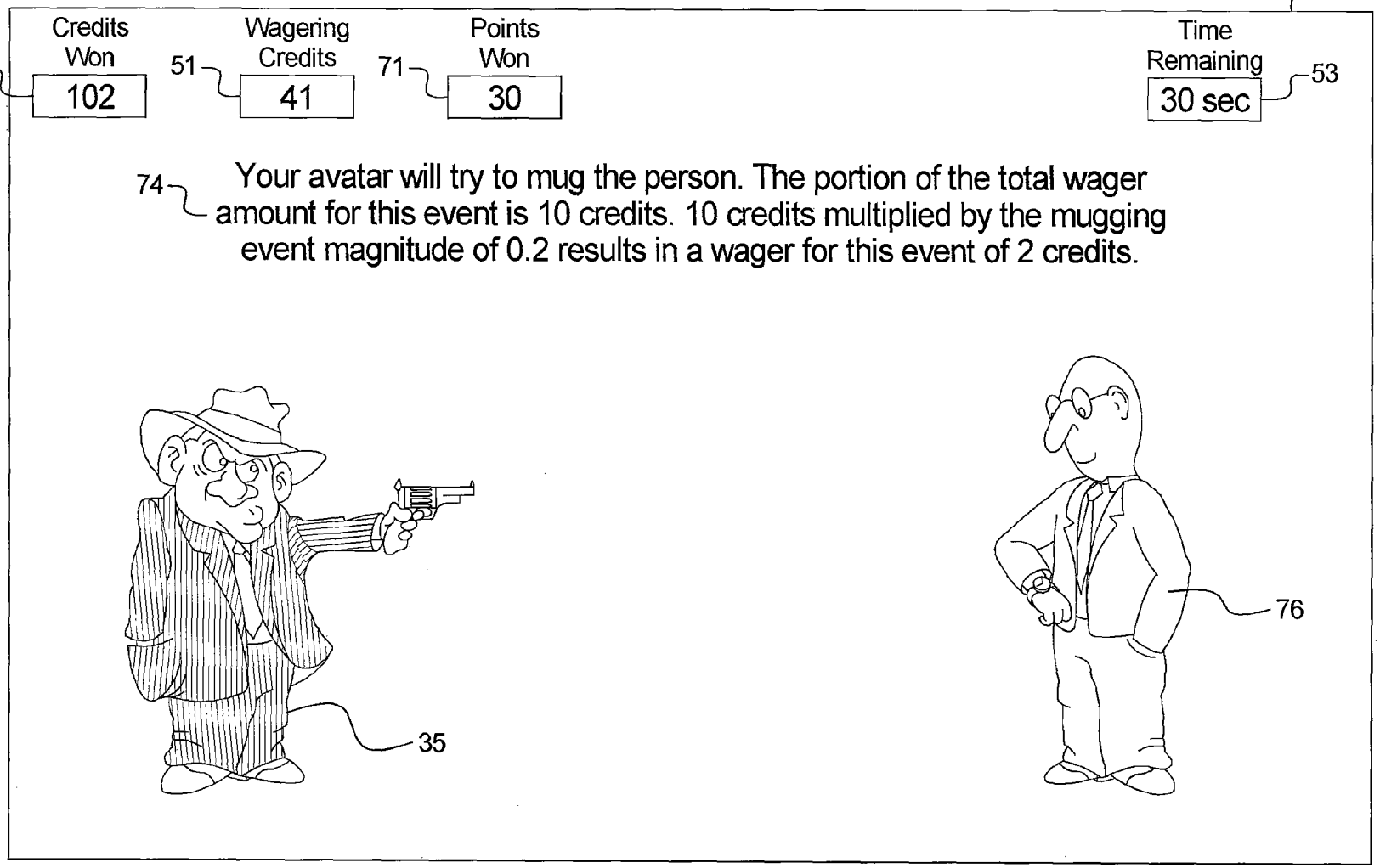
Figure 5J:
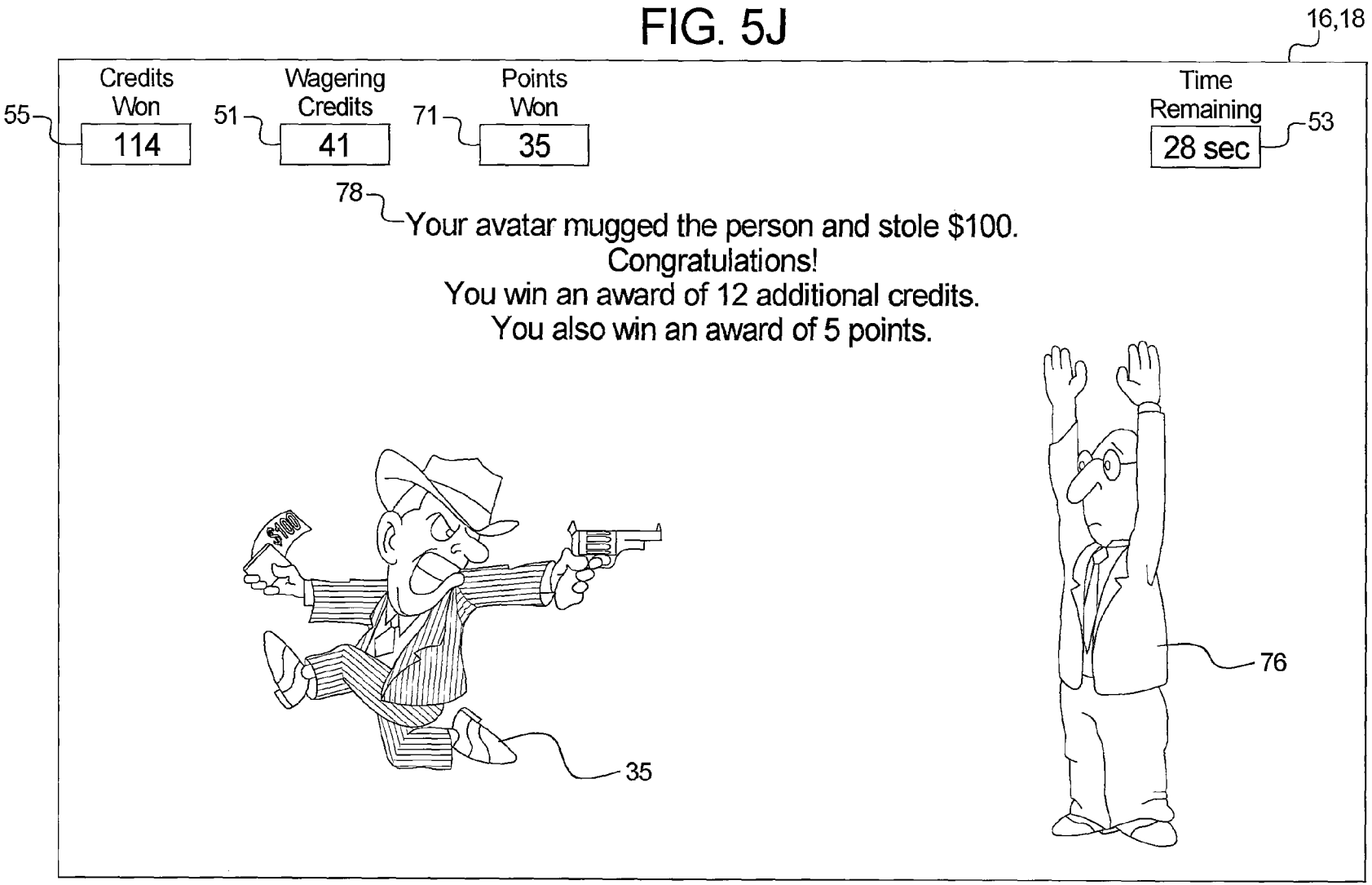
Figure 5K:
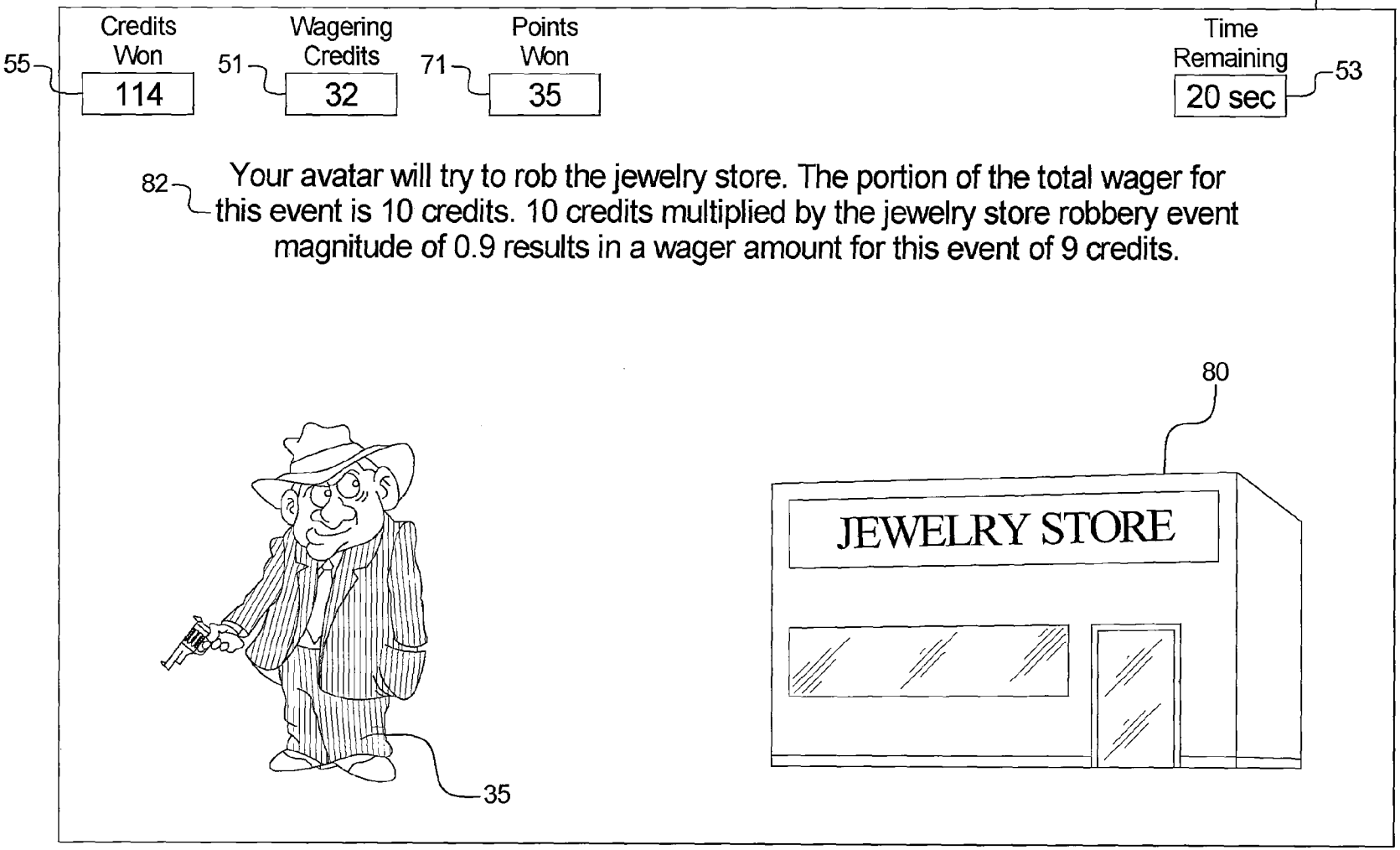
Figure 5L:
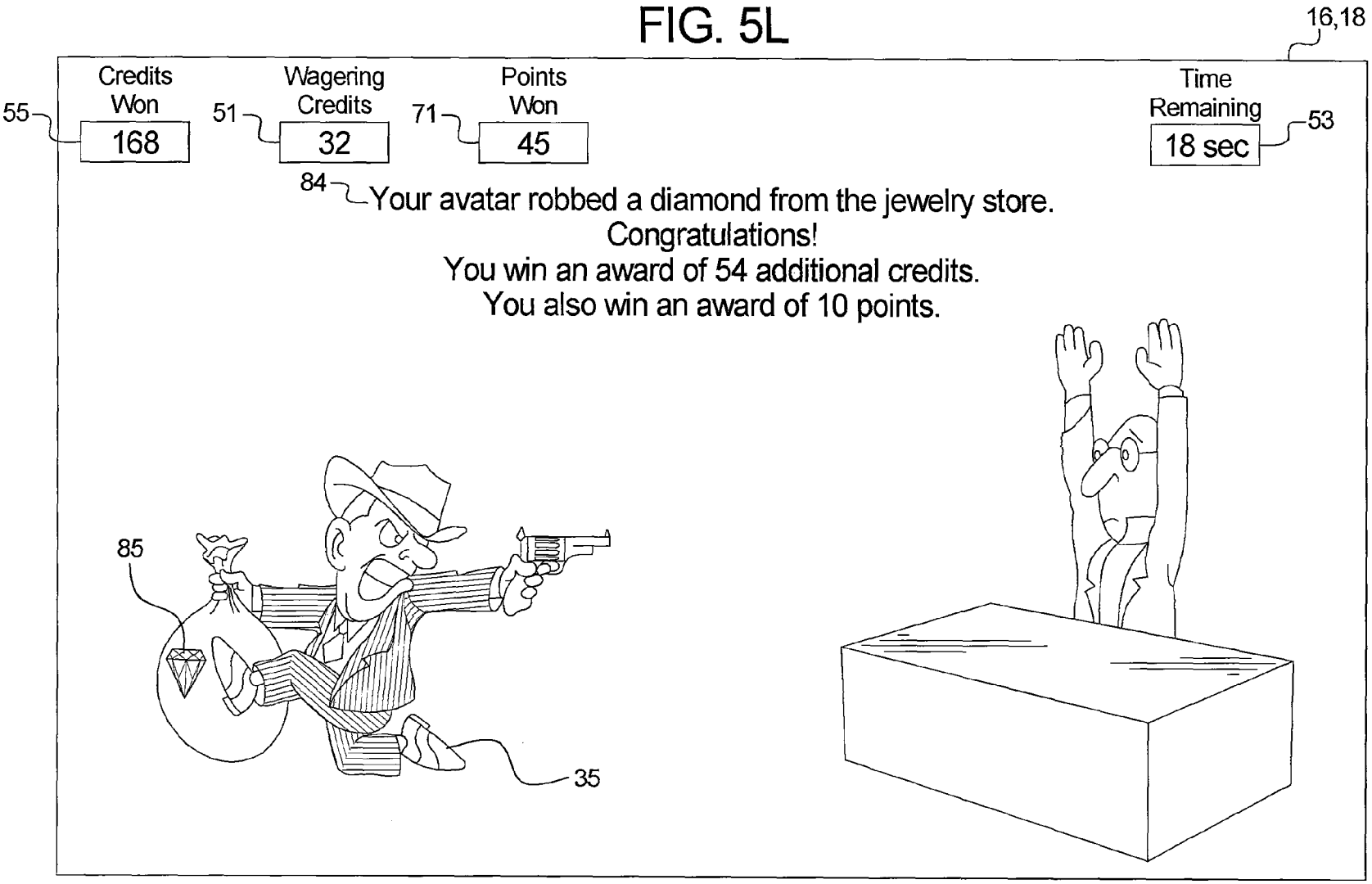
Figure 5M:
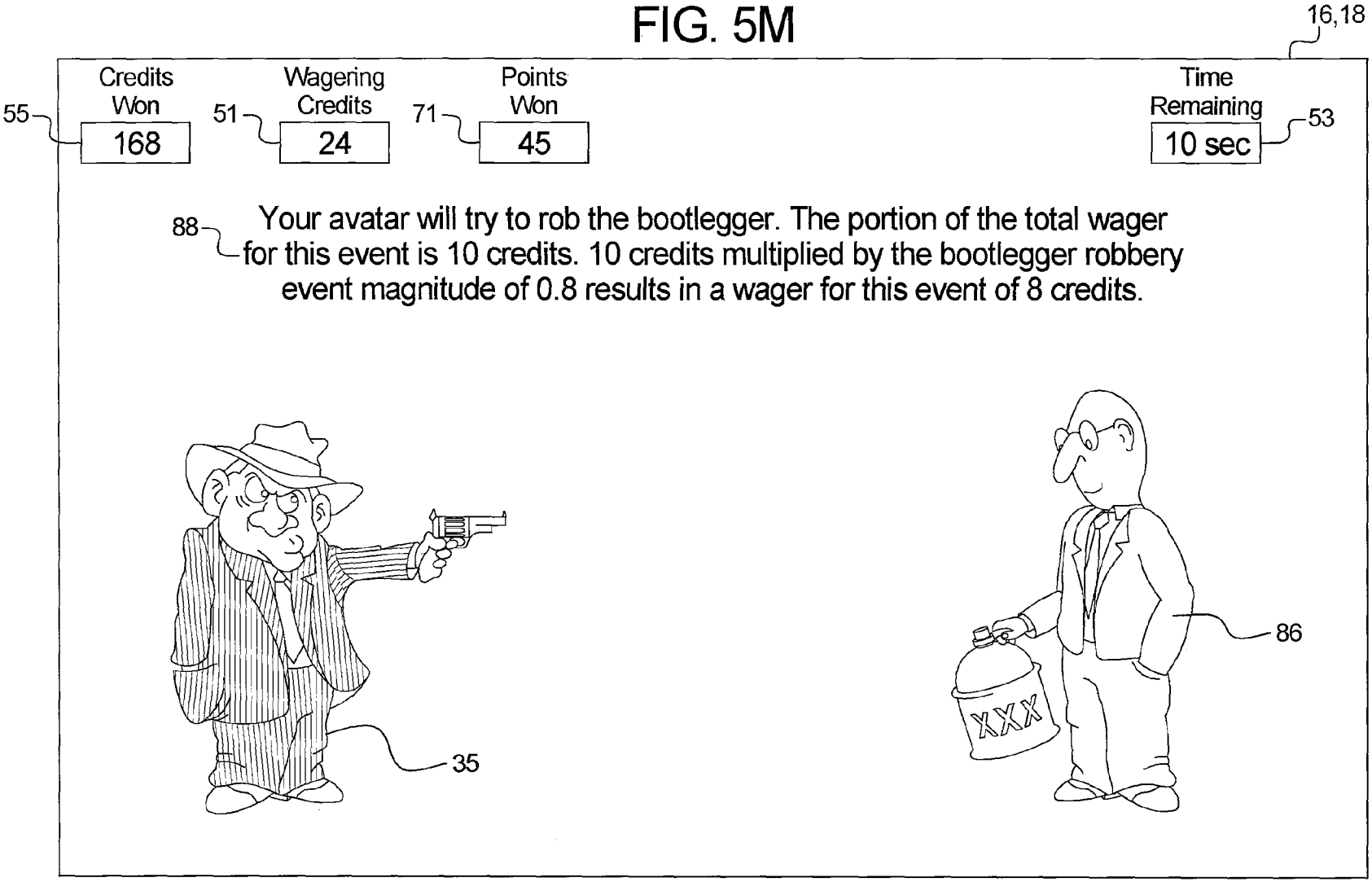
Figure 5N:
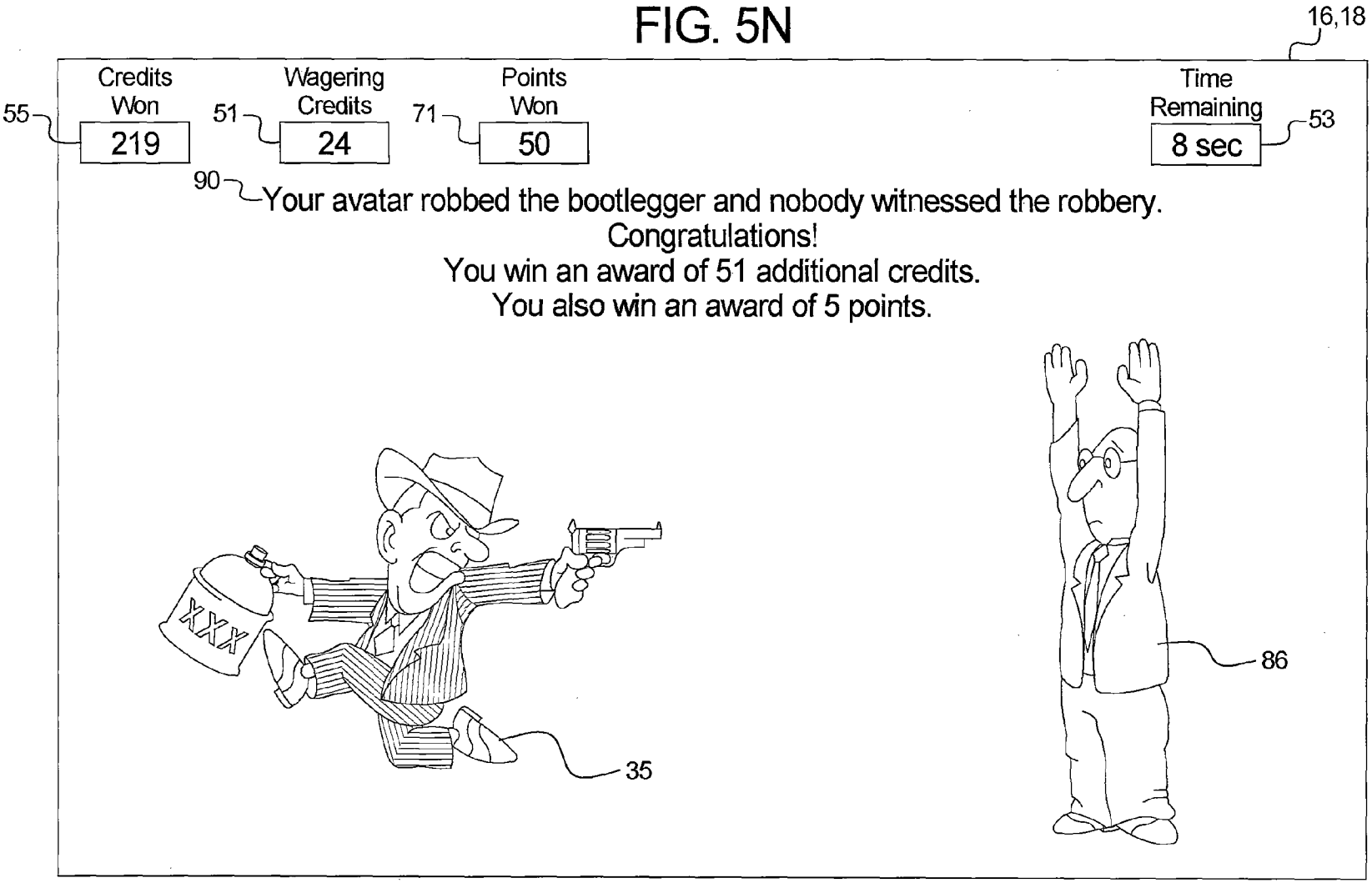
Figure 5O:
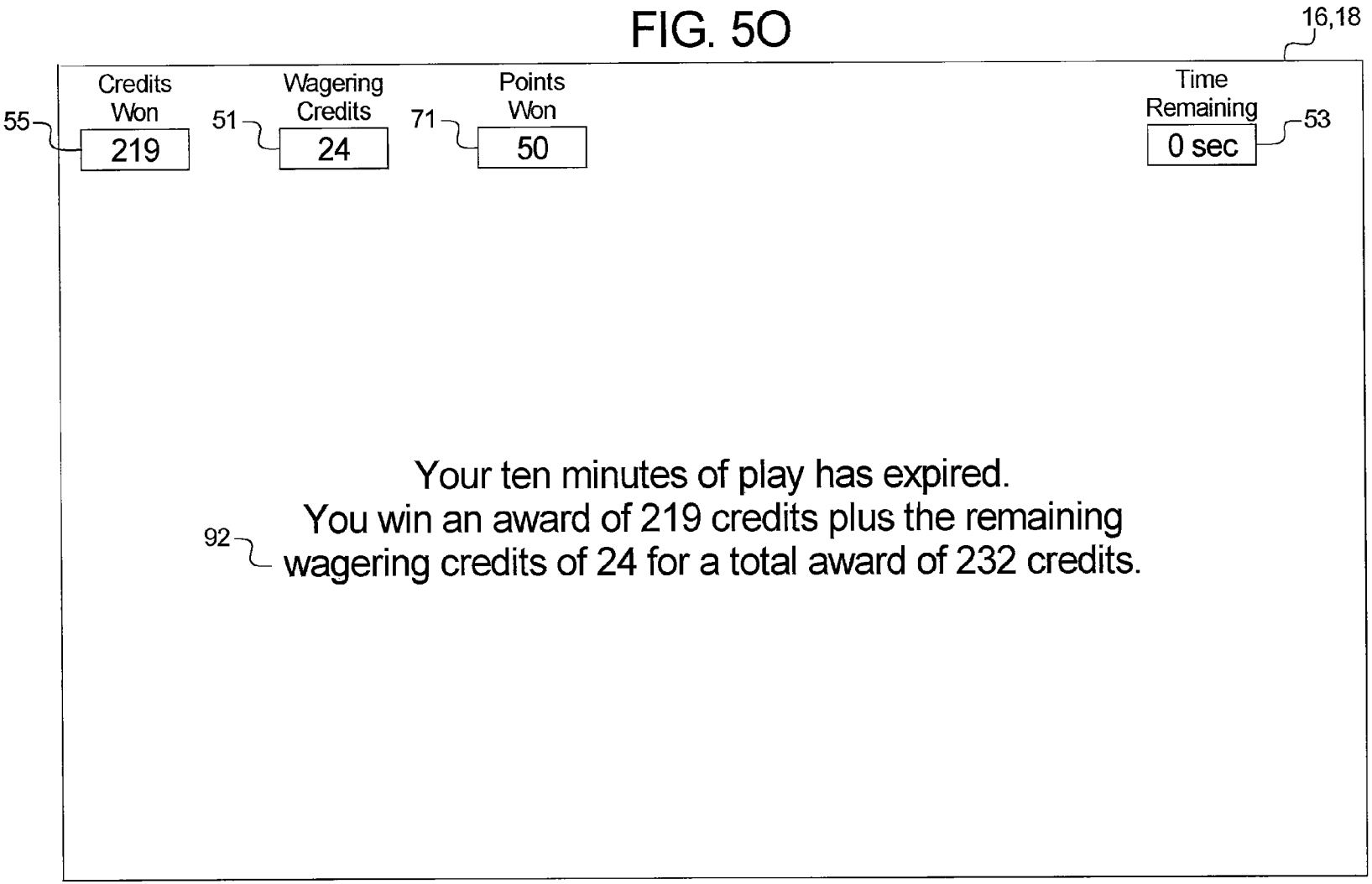

Referring more specifically to FIGS. 5A to 5O, in one such embodiment, the gaming system enables a player to place a total wager for a game session over a designated period of time and provides a plurality of different wagering events. In this embodiment, the player places a total wager to play a gangster style video game theme session for a designated period of time. In the gangster style game theme, the gaming system causes the gangster avatar to traverse a virtual gangster world in which the gangster avatar engages in various wagering events that are typically associated with gangster activities, such as robberies, thefts and muggings. It should be appreciated that while the gangster theme is used herein as an example embodiment, other suitable game themes, games or wagering events can be employed in accordance with the present disclosure.

The gaming system associates different event magnitudes with different wagering events in the gangster game theme. For example, as illustrated by the Table of FIG. 4, the gaming system associates event magnitudes 64*a*, 64*b*, 64*c*, 64*d*, 64*e* and 64*f* with each of the different wagering events 62*a*, 62*b*, 62*c*, 62*d*, 62*e* and 62*f* for the embodiment of FIGS. 5A to 5O. In this embodiment, the gaming system provides a game session that includes six different wagering events 62*a*, 62*b*, 62*c*, 62*d*, 62*e* and 62*f* such as those typically associated with gangster activities which can occur during the game session. Each wagering event can occur a designated number of times (such as one or more times) during the gaming session. It should be appreciated that in other embodiments, the gaming system limits the number of times one or more wagering events can occur during the game session. The first wagering event 62*a* is a bank robbery associated with an event magnitude of 1.0 labeled as 64*a*. The second wagering event 62*b* is a jewelry store robbery associated with an event magnitude of 0.9 labeled as 64*b*. The third wagering event 62*c* is a robbery of a bootlegger associated with an event magnitude of 0.85 labeled as 64*c*. The fourth wagering event 62*d* is a car theft associated with an event magnitude of 0.7 labeled as 64*d*. The fifth wagering event 62*e* is a mugging associated with an event magnitude of 0.2 labeled as 64*e*. The sixth wagering event 62*f* is a robbery of a truck driver associated with an event magnitude of 0.9 labeled as 64*f*. It should be appreciated that while in this example embodiment the gaming system associates a plurality of wagering events with magnitudes that are less than or equal to one, in other embodiments, the gaming system associates one or more wagering events with magnitudes that are greater than one.

In various different embodiments, the gaming system displays the event magnitudes to the player: (i) prior to the player engaging in the events, (ii) at the point in time when the player or avatar engages in any one of the wagering events, (iii) over the entire designated time period for the game session, (iv) or at any suitable time period during the game session. In other embodiments, the gaming system does not display the magnitudes to the player. In the embodiment illustrated by FIGS. 5A to 5O, the Table 86 of FIG. 4 is merely illustrative and the gaming system does not display the event magnitudes to the player at all.

Referring more specifically to the embodiment illustrated by FIGS. 5A to 5O, the gaming system first requests the player to place a wager for a game session which occurs over a designated period of time, as illustrated by FIG. 5A. The gaming system requests the player to place a wager for the game session by displaying on display device 16,18 message 45, "PLEASE PLACE A WAGER TO PLAY A GAME SESSION FOR A PERIOD OF TIME SET FORTH BELOW." It should be appreciated that in the various embodiments disclosed herein, the gaming system prompts, or messages, could be any suitable type of message or prompt such as an audio, visual or audio/visual prompt. The gaming system also displays five selectable wagering options 47*a*, 47*b*, 47*c*, 47*d* and 47*e*. The gaming system enables the player to select one of the selectable wagering options. Each selectable wagering option corresponds to a designated period of time for the game session. The longer the period of time the player wishes the game session to occur, the greater number of credits the gaming system requires the player to wager. That is, the gaming system displays five different selectable wagering options 47*a*, 47*b*, 47*c*, 47*d*, 47*e* and 47*f* of 60 credits for a game session of 1 minute, 120 credits for a game session of 2 minutes, 180 credits for a game session of 3 minutes, 240 credits for a game session of 4 minutes and 300 credits for a game session of 5 minutes. The player 49 selects a game session for a time period of 1 minute for 60 credits. In one embodiment, the gaming system could offer one or more selectable wagering options that are discounted. For example, the gaming system may offer a selectable wagering option of 300 credits for a game session of 6 minutes instead of a game session of 5 minutes.

The gaming system displays the result of the player selecting to play a game session with a gangster style game theme, as illustrated by FIG. 5B. In this embodiment, the gaming system displays a number of different player selectable game avatars 31. Each avatar represents a particular game theme for the game session. The gaming system displays three different player selectable avatars; a prohibition style gangster 35, a military soldier 37, and a cartoon character 39. The gaming system prompts the player to select a game by displaying a suitable message, such as message 33 of, "PLEASE SELECT A GAME THEME AVATAR." The player 49 selects the prohibition era gangster avatar 35.

The gaming system then displays the gangster avatar and message 57 of, "YOU HAVE SELECTED TO PLAY THE GANGSTER GAME AND PLACED A TOTAL WAGER OF 60 CREDITS TO PLAY THE GAME FOR ONE MINUTE. IN THE GANGSTER GAME, YOUR AVATAR WILL ENGAGE IN VARIOUS EVENTS," as illustrated by FIG. 5C. The gaming system also displays a wagering credits display 51 showing the amount of wagering credits of 60 credits for the play of the gangster game theme, a credits won display 55, and a points won display 71. The credits won display and the points won display each display zero because no credits or points have been provided to the player at this time. The gaming system also displays a time remaining display 53, which shows the amount of time remaining of 60 seconds in the gangster game theme. The gaming system then displays message 59 of, "A WAGER AMOUNT WILL BE DETERMINED FOR EACH EVENT IN WHICH YOUR AVATAR ENGAGES. THE WAGER AMOUNT IS DETERMINED BASED ON A PORTION OF YOUR TOTAL WAGER MULTIPLIED BY THE MAGNITUDE ASSOCIATED WITH THAT EVENT," as illustrated by FIG. 5D.

The gaming system displays the gangster approaching a bank 63 to engage in a first event of trying to rob the bank, as generally illustrated by FIG. 5E. The gaming system determines a wager amount for the bank robbery event at this point in time. In this embodiment, when the gangster avatar decides to rob the bank, the gaming system determines a portion of the total wager based at least in part on the amount of time transpired since the beginning of the game. Ten seconds has elapsed since the beginning of the game, as illustrated by the time of 50 seconds shown in the time remaining display 53 and thus the gaming system determines that the portion of the total wager for this wagering event is 10 credits. The gaming system then determines a wager for the bank robbery event by multiplying the determined portion of the total wager associated with the bank robbery event by the magnitude associated with the bank robbery event. The determined portion of the of the total wager associated with the bank robbery event is 10 credits. The event magnitude for the bank robbery event is 1.0, as illustrated in the Table of FIG. 4. Thus, the gaming system multiplies the 10 credits by the magnitude of one, resulting in a wager amount of 10 credits for the bank robbery event. The gaming system displays message 61 of, "YOUR AVATAR WILL TRY TO ROB THE BANK. THE PORTION OF THE TOTAL WAGER FOR THIS EVENT IS 10 CREDITS. 10 CREDITS MULTIPLIED BY THE BANK ROBBERY EVENT MAGNITUDE OF ONE RESULTS IN A WAGER FOR THIS EVENT OF 10 CREDITS." The gaming system displays the total wager amount remaining of 50 credits in the wagering credits display 51, which results form the wager amount of 10 credits being subtracted from the initial amount of wagering credits available of 60.

The gaming system then causes the first event to occur and determines a first outcome and a second outcome for the first event, as illustrated by FIG. 5F. In this illustrated embodiment, the gaming system determined both a points outcome and a credits outcome for the first wagering event. That is, the gaming system determined the points outcome is the gangster successfully robbing the bank. The gaming system determined an award of 20 points is associated with the determined points outcome of successfully robbing the bank and provided the 20 points to the player, as indicated by the points won display 71. The gaming system also randomly determined the credits outcome of $1000 dollars. That is, the gaming system randomly determined that the gangster stole $1000 dollars from the bank. The gaming system determined an award of 60 credits is associated with the determined credits outcome of $1000 dollars and the wager of 10 credits. The gaming system provided the 60 additional credits to the player, as indicated by the display of the 60 credits in the credits won display 55. In this embodiment, the gaming system displayed the amount the gangster stole from the bank after displaying the gangster having successfully robbed the bank. The gaming system displays message 65 of, "YOUR AVATAR ROBBED $1000 FROM THE BANK. CONGRATULATIONS! YOU WIN AWARD OF 60 CREDITS. YOU ALSO WIN AN AWARD OF 20 POINTS."

The gaming system then displays the gangster approaching a really expensive car 70 to engage in a second event of trying to steal the car, as illustrated by FIG. 5G. The gaming system determines a wager amount for stealing the car at this point in time. In this embodiment, when the gangster avatar decides to steal the car, the gaming system determines a portion of the total wager based at least in part on the amount of time transpired since the previous wagering event. Ten seconds has elapsed since the previous wagering event, as illustrated by the time of 40 seconds shown in the time remaining display 53 and thus the gaming system determines that the portion of the total wager for this wagering event is 10 credits. The gaming system then determines a wager for the car theft event by multiplying the determined portion of the total wager by the magnitude associated with the car theft event. The determined portion of the total wager is 10 credits. The event magnitude for the car theft event is 0.7, as illustrated in the Table of FIG. 4. The gaming system multiplies the 10 credits by the magnitude of 0.7, resulting in a wager amount of 7 credits for the car theft event. The gaming system displays message 68 of, "YOUR AVATAR WILL TRY TO STEAL THE CAR. THE PORTION OF THE TOTAL WAGER FOR THIS EVENT IS 10 CREDITS. 10 CREDITS MULTIPLIED BY THE CAR THEFT MAGNITUDE OF 0.7 RESULTS IN A WAGER FOR THIS EVENT OF 7 CREDITS." The gaming system displays the total wager amount remaining of 43 credits in the wagering credits display 51, which results from the wager amount of 7 credits being subtracted from the previous wagering credits amount of 50.

The gaming system then causes the second event to occur and determines a first outcome and a second outcome for the second event, as illustrated by FIG. 5H. In this illustrated embodiment, the gaming system determined both a points outcome and a credits outcome for the second wagering event. That is, the gaming system determined the points outcome is the gangster successfully stealing the car. The gaming system determined an award of 10 points is associated with the determined points outcome of successfully stealing the car and provided the 10 points to the player, as indicated by the 30 total points shown in the points won display 71. The gaming system also randomly determined a points outcome. That is, the gaming system randomly determined that the gangster successfully eluded the police after stealing the car. The gaming system determined an award of 42 additional credits is associated with the determined credits outcome of eluding the police and the wager of 7 credits. The gaming system provided the 42 additional credits to the player, as indicated by the display of the 102 credits in the credits won display 55. The gaming system displays message 72 of, "YOUR AVATAR STOLE THE CAR AND WAS NOT CAUGHT BY THE POLICE. CONGRATULATIONS! YOU WIN AWARD OF 42 ADDITIONAL CREDITS. YOU ALSO WIN AN AWARD OF 10 POINTS."

The gaming system then displays the gangster approaching a person 76 on the street to engage in a third event of trying to mug the person, as illustrated by FIG. 5I. The gaming system determines a wager amount for mugging the person at this point in time. In this embodiment, when the gangster avatar decides to mug the person, the gaming system determines a portion of the total wager based at least in part on the amount of time transpired since the previous wagering event. Ten seconds has elapsed since the previous wagering event, as illustrated by the time of 30 seconds shown in the time remaining display 53 and thus the gaming system determines that the portion of the total wager for this wagering event is 10 credits. The gaming system then determines a wager for the mugging event by multiplying the determined portion of the total wager associated with the mugging event by the magnitude associated with the mugging event. The determined portion of the total wager for the mugging event is 10 credits. The event magnitude for the mugging event is 0.2, as seen in the Table of FIG. 4. The gaming system multiplies the 10 credits by the magnitude of 0.2, resulting in a wager amount of 2 credits for the mugging event. The gaming system displays the message 74 of, "YOUR AVATAR WILL TRY TO MUG THE PERSON. THE PORTION OF THE TOTAL WAGER AMOUNT ASSOCIATED WITH THIS EVENT IS 10 CREDITS. 10 CREDITS MULTIPLIED BY THE MUGGING EVENT MAGNITUDE OF 0.2 RESULTS IN A WAGER AMOUNT FOR THIS EVENT OF 2 CREDITS." The gaming system displays the total wager amount remaining of 41 credits in the wagering credits display 51, which results from the wager amount of 2 credits being subtracted from the previous wagering credits amount of 43 credits.

The gaming system then causes the third event to occur and determines a first outcome and a second outcome for the third event, as illustrated by FIG. 5J. In this illustrated embodiment, the gaming system determined both a points outcome and a credits outcome for the third wagering event. That is, the gaming system determined the points outcome is the gangster successfully mugging the person. The gaming system determined an award of 5 points is associated with the determined points outcome of successfully mugging the person and provided 5 points to the player, as indicated by the display of the 35 total points in the points won display 71. The gaming system also randomly determined the credits outcome of $100. That is, the gaming system randomly determined that the gangster stole $100 dollars from the person. The gaming system determined an award of 12 additional credits is associated with the determined credits outcome of $100 dollars and the wager of 2 credits. The gaming system provided the 12 additional credits to the player, as indicated by the credits won display 55 showing 114 credits. In this embodiment, the gaming system displayed the amount the gangster stole from the person after displaying the gangster having successfully mugged the person. The gaming system displays message 78 of, "YOUR AVATAR MUGGED THE PERSON AND STOLE $100. CONGRATULATIONS! YOU WIN AWARD OF 12 ADDITIONAL CREDITS. YOU ALSO WIN AN AWARD OF 5 POINTS."

The gaming system then displays the gangster approaching a jewelry store 80 to engage in a fourth event of trying to rob the jewelry store 80, as illustrated by FIG. 5K. The gaming system determines a wager amount for the jewelry store robbery event at this point in time. In this embodiment, when the gangster avatar decides to rob the jewelry store, the gaming system determines a portion of the total wager based at least in part on the amount of time transpired since the previous wagering event. Ten seconds has elapsed since the previous wagering event, as illustrated by the time of 20 seconds shown in the time remaining display 53 and thus the gaming system determines that the portion of the total wager for this wagering event is 10 credits. The gaming system then determines a wager for the mugging event by multiplying the determined portion of the total wager associated with the jewelry store robbery event by the magnitude associated with the jewelry store robbery event. The determined portion of the total wager for the jewelry store robbery event is 10 credits. The event magnitude for the jewelry store robbery event is 0.9, as illustrated in the Table of FIG. 4. The gaming system multiplies the 10 credits by the magnitude of 0.9, resulting in a wager amount of 9 credits for the jewelry store robbery event. The gaming system displays message 82 of, "YOUR AVATAR WILL TRY TO ROB THE JEWELRY STORE. THE PORTION OF THE TOTAL WAGER AMOUNT FOR THIS EVENT IS 10 CREDITS. 10 CREDITS MULTIPLIED BY THE JEWELRY STORE ROBBERY EVENT MAGNITUDE OF 0.9 RESULTS IN A WAGER AMOUNT FOR THIS EVENT OF 9 CREDITS." The gaming system displays the total wager amount remaining of 32 credits in the wagering credits display 51, which results from the wager amount of 9 credits being subtracted from the previous wager amount of 41 credits.

The gaming system then causes the fourth event to occur and determines a first outcome and a second outcome for the fourth event, as illustrated by FIG. 5L. In this illustrated embodiment, the gaming system determined both a points outcome and a credits outcome for the fourth wagering event. That is, the gaming system determined the points outcome is the gangster successfully robbing the jewelry store. The gaming system determined an award of 10 points is associated with the determined points outcome of successfully robbing the jewelry store and provided 10 points to the player, as indicated by the display of the 45 total points, in the points won display 71. The gaming system also randomly determined the points outcome of a diamond. That is, the gaming system randomly determined that the gangster stole a diamond from the jewelry store. The gaming system determined an award of 54 credits is associated with the determined points outcome of stealing a diamond and the wager of 9 credits. The gaming system provided the 54 additional credits to the player, as indicated by the credits won display 55 showing 168 credits. In this embodiment, the gaming system displays the gangster having stole the diamond after displaying the gangster having successfully robbed the jewelry store. The gaming system displays message 84 of, "YOUR AVATAR ROBBED A DIAMOND FROM THE JEWELRY STORE. CONGRATULATIONS! YOU WIN AWARD OF 54 ADDITIONAL CREDITS. YOU ALSO WIN AN AWARD OF 10 POINTS."

The gaming system then displays the gangster approaching a bootlegger to engage in a fifth event of trying to rob a bootlegger, as illustrated by FIG. 5M. The gaming system determines a wager amount for robbing the bootlegger at this point in time. In this embodiment, when the gangster avatar decides to rob the jewelry store, the gaming system determines a portion of the total wager based at least in part on the amount of time transpired since the previous wagering event. Ten seconds has elapsed since the previous wagering event, as illustrated by the time of 10 seconds shown in the time remaining display 53 and thus the gaming system determines that the portion of the total wager for this wagering event is 10 credits. The gaming system determines a wager amount for the bootlegger robbery event by multiplying the determined portion of the total wager by the magnitude associated with bootlegger robbery event. The determined portion of the total wager associated with the bootlegger robbery event is 10 credits. The event magnitude for the bootlegger robbery event is 0.80, as illustrated by the Table of FIG. 4. The gaming system multiplies the 10 credits by the magnitude of 0.80, resulting in a wager amount of 8 credits for the bootlegger robbery event. The gaming system displays message 88 of, "YOUR AVATAR WILL TRY TO ROB THE BOOTLEGGER. THE PORTION OF THE TOTAL WAGER AMOUNT FOR THIS EVENT IS 10 CREDITS. 10 CREDITS MULTIPLIED BY THE BOOTLEGGER ROBBERY EVENT MAGNITUDE OF 0.80 RESULTS IN A WAGER FOR THIS EVENT OF 8 CREDITS." The gaming system displays the total wager amount remaining of 24 credits in the wagering credits display 51, which results from the wager amount of 17 credits being subtracted from the previous wagering credits amount of 44 credits.

The gaming system then causes the fifth event to occur and determines at a first outcome and a second outcome for the fifth event, as illustrated by FIG. 5N. In this illustrated embodiment, the gaming system determines both a points outcome and a credits outcome for the fifth wagering event. That is, the gaming system determined the points outcome is the gangster successfully robbing the bootlegger. The gaming system determined an award of 5 points is associated with the determined credits outcome of successfully robbing the bootlegger and provided the 5 points to the player, as indicated by the display of the 45 total points in the points won display 71. The gaming system also randomly determined the points outcome of the gangster robbing the bootlegger with nobody witnessing the robbery (i.e., no witnesses). That is, the gaming system randomly determined that nobody witnessed the robbery. The gaming system determined an award of 51 additional credits is associated with the credits outcome of no witnesses and the wager of 8 credits. The gaming system provided the 51 additional credits to the player, as indicated by the credits won display 55 showing 219 credits. The gaming system displays message 90 of, "YOUR AVATAR ROBBED THE BOOTLEGGER AND NOBODY WITNESSED THE ROBBERY. CONGRATULATIONS! YOU WIN AWARD OF 51 ADDITIONAL CREDITS. YOU ALSO WIN AN AWARD OF 10 POINTS."

After the designated period of time elapses for which the player placed a total wager to play the gangster game, the gaming system displays the termination of the play of the gangster game, as illustrated by FIG. 5O. The gaming system provides the player with an award equal to the total number of points earned from playing the game of 217 plus the remaining number of wagering credits of 27, for a total award of 236 credits. The gaming system displays message 92 of, "YOUR TEN MINUTES OF PLAY HAS EXPIRED. YOU WIN AN AWARD OF 219 CREDITS PLUS THE REMAINING WAGERING CREDITS OF 24 FOR A TOTAL AWARD OF 232 CREDITS!" It should be appreciated that in various other embodiments, the gaming system provides the player with an additional award for the total number of points won.

It should be appreciated that while the above example embodiment includes a gangster video game theme, in other embodiments the gaming system is configured to provide a game session that includes any suitable type of video game theme which includes a plurality of different wagering events. For example, in one embodiment, the gaming system is configured to provide an outer space shooting video game theme which includes a plurality of wagering events, such as spaceship shooting at various elements (such as asteroids, or aliens) during the game session.

In the above example embodiment, the gaming system determines an award is associated with both the first outcome and the second outcome for each wagering event. It should be appreciated that in various other embodiments, the gaming system determines, for one or more wagering events, that an award is not associated with the first and/or second outcome. In one embodiment, the gaming system determines an award is not associated with the first outcome and is not associated with the second outcome. For example, for the bank robbery event in the example embodiment described above, the gaming system determines that the gangster did not succeed in robbing the bank. The determined outcome of failing to succeed in robbing the bank is not associated with an award. Because the gangster did not succeed in robbing the bank, the gaming system determines the second outcome also is not associated with an award. That is, the gaming system determines the second outcome of zero dollars having been stolen is not associated with an award.

In another embodiment, the gaming system determines the first outcome is not associated with an award and determines the second outcome is associated with an award. For example, if the gaming system determines the gangster did not succeed in robbing the bank (which is not associated with an award), the gaming system determines that the gangster nevertheless avoided being captured by the police. The determined outcome of avoiding capture by the police is associated with an award.

In another embodiment, the gaming system determines the first outcome is associated with an award and determines the second outcome is not associated with an award. For example, for the mugging event, the gaming system determines the gangster stole the person's wallet (which is associated with an award), but the gaming system determines there is no money in the wallet. The determined outcome of no money in the wallet is not associated with an award.

It should be appreciated that in various other embodiments, for one or more wagering events, the gaming system determines the first outcome is associated with an award and determines the second outcome is not associated with an award. For example, for the mugging event in the example embodiment described above, the gaming system determines the gangster succeeded in the mugging event by taking the person's wallet, but determines that there is no money in the wallet. That is, the gaming system determines the second outcome is no money in the wallet. The second outcome of no money in the wallet is not associated with an award.

Figure 6A:
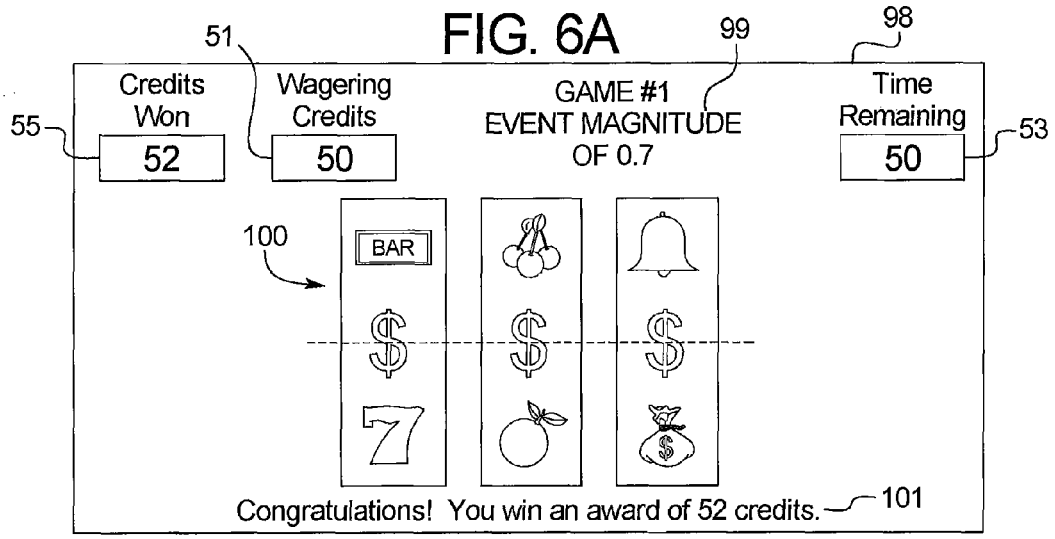
FIGS. 6A, 6B and 6C are three front views of a gaming device display enabling a play of game session in accordance with an embodiment of the gaming device disclosed herein.
Figure 6B:
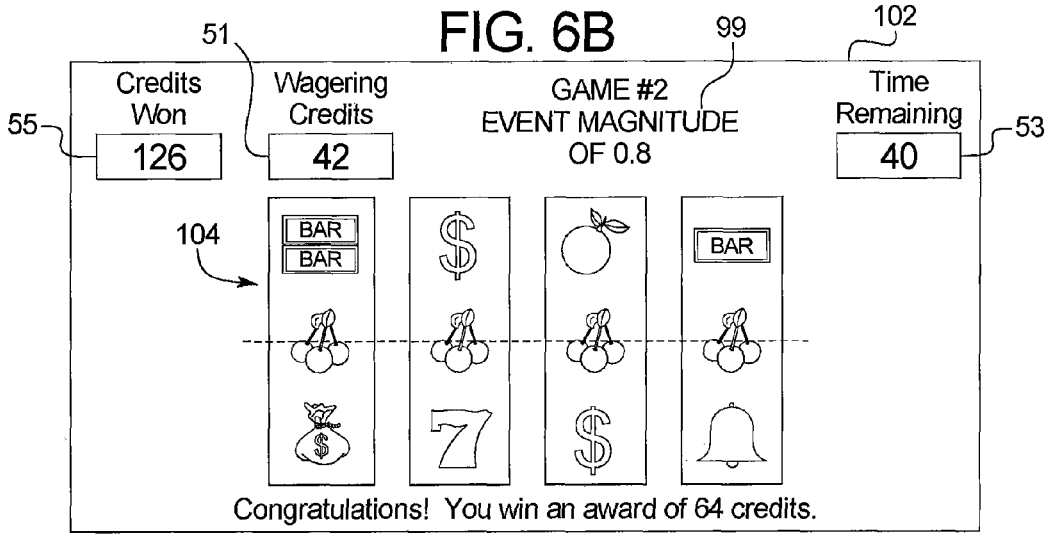
Figure 6C:
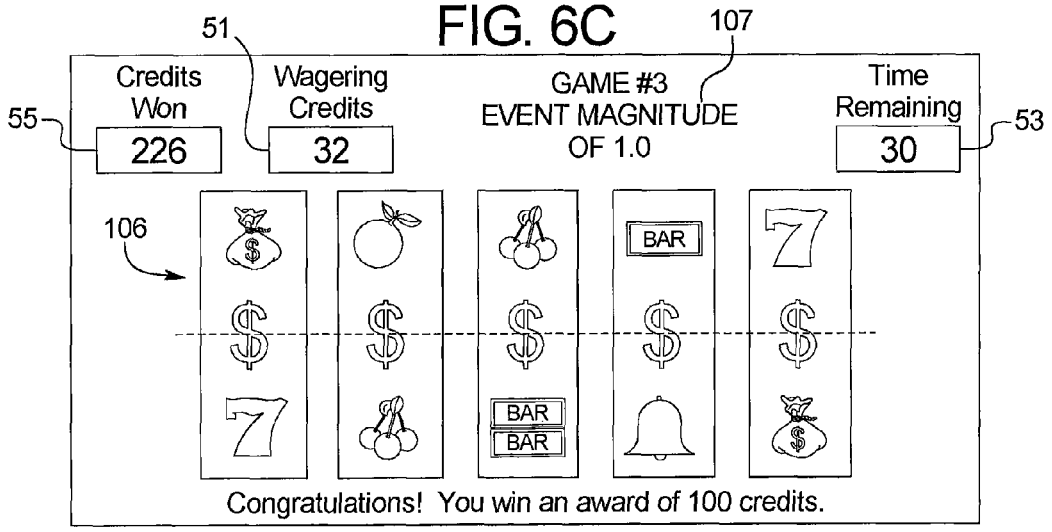

In another embodiment, instead of the gaming system being configured to provide a game session associated with a plurality of different wagering events that are particular events, such as illustrated in the embodiment of FIGS. 5A to 5O, the gaming system is configured to provide a game session associated with a plurality of different wagering events that are games. In one such embodiment, the gaming system provides a games session associated with a plurality of different slot games, wherein each slot game includes a different number of reels. In one such example embodiment, the gaming system receives a wager to play a game session over a designated period of time and the game session includes three different slot games, as illustrated by FIGS. 6A to 6C. In this embodiment, the game session includes a first slot game 98 with three reels 100, a second slot game 102 with four reels 104, and a third slot game with five reels 105, as illustrated by FIGS. 6A to 6C respectively. For each of the different slot games, the gaming system determines a portion of the total wager amount for that game, causes the game to occur, randomly displays an outcome for the game based at least in part on the determined portion of the total wager and the displayed outcome, and provides an award.

For example, the gaming system determines an award for the three slot reel game illustrated in FIG. 6A. Ten seconds elapsed since the beginning of the game session and thus the gaming system determines a potion of the total wager to be 10 credits for this wagering event. The game of three slot reels is associated with a magnitude of 0.7 as displayed by the message 99 of "GAME #1, EVENT MAGNITUDE OF 0.7." The gaming system determines a wager for the game by multiplying the game magnitude of 0.7 by the determined portion of the total wager of 10 credits for a wager of 7 credits. The gaming system spun the reels and randomly determined an outcome of a winning symbol combination of three cherries across a payline and provides an award of 52 credits to the player for the randomly determined outcome of three cherries. The award of 52 credits is based on the determined wager of 14 credits and the randomly determined winning symbol combination.

As illustrated by FIG. 6B, the gaming system determines an award for the four reel slot game. Ten seconds elapsed since the previous game, as illustrated by the time of 40 seconds shown in the time remaining display 53, and thus the gaming system determines a portion of the total wager to be 10 credits. The game of four slot reels is associated with a magnitude of 0.8 as displayed by message 99 of "GAME #2, EVENT MAGNITUDE OF 0.8." The gaming system determines a wager for the game by multiplying the game magnitude of 0.8 by the determined portion of the total wager of 10 credits for a wager of 8 credits. The gaming system spun the reels and randomly determined an outcome of a winning symbol combination of four dollar signs across a payline and provides an award of 64 credits to the player for the randomly determined outcome of four dollar signs. The award of 64 credits is based on the determined wager of 14 credits and the randomly determined symbol combination.

As illustrated by FIG. 6C, the gaming system determines an award for the five reel slot game. Ten seconds elapsed since the previous game, as illustrated by the time of 30 seconds shown in the time remaining display 53, and thus the gaming system determines a portion of the total wager to be 10 credits. The game of five slot reels is associated with a magnitude of 1.0 as displayed by message 107 of "GAME #3, EVENT MAGNITUDE OF 1.0" The gaming system determines a wager for the game by multiplying the game magnitude of 1.0 by the determined portion of the total wager of 10 credits for a wager of 10 credits. The gaming system spun the reels and randomly determined an outcome of a winning symbol combination of five dollar signs across a payline and provides an award of 100 credits to the player. The award of 100 credits is based on the determined wager of 14 credits and the randomly determined winning symbol combination. The gaming system ends the game session at the termination of the designated period of time in any suitable manner described herein.

In other embodiments, instead of the gaming system being configured to provide a game session that is associated with a number of different slot games, the gaming system is configured to provide a game session associated with a number of different types of games, such as a slot game, a card game such as poker or blackjack, a bingo game, a keno game, or any other suitable game or combination of such suitable games.

In another embodiment, the player determines which particular events or games will occur during the game session. For example, in one embodiment, the gaming system enables the player to select from a number of different events and/or games that will occur during the game session. In another embodiment, the gaming system determines which events or games will occur during the game session. In another embodiment, both the gaming system and the player determine which of the events and/or games will occur during the game session. In one embodiment, such as the embodiment illustrated in FIGS. 5A to 5O, the gaming system determines the sequence in which the events or games occur. In different embodiments, the gaming system and/or the player determines the sequence in which the games or events occur.

In various embodiments, the gaming system provides any suitable number and/or of different games or events. In additional embodiments, the gaming system displays any suitable game theme avatar representing any particular type of game theme and enables the player to select any one of the avatars. In another embodiment, the gaming system enables a player to select any particular type of game or game theme in any suitable fashion. In other embodiments, the gaming system selects the particular type of game or game theme for the player. In various embodiments, the determination of the particular type of game theme is randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the total wager amount received, or determined based on any other suitable method or criteria.

In one embodiment, for each of the different game themes, the gaming system associates a different average expected payout with that game theme. In one such embodiment, the gaming system associates a different volatility with each of the different game themes. In another such embodiment, the gaming system associates the same volatility with each of the game themes.

In another embodiment, for each of the different game themes, the gaming system associates the same average expected payout with that game theme. In one such embodiment, the gaming system associates a different volatility with each of the different game themes. In another such embodiment, the gaming system associates the same volatility with each of the game themes.

In one embodiment, instead of the gaming system directing an avatar to engage in a particular wagering event, the gaming system enables the player to direct the avatar to engage in one or more of the wagering events. That is, the player decides which wagering events the avatar will engage in during the game session. The player's determination of which wagering events the avatar will engage in can be made at the beginning of the game or at any point in time during the game session. In other embodiments, the determination of which wagering events the avatar will engage is randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another embodiment, for each of the plurality of different wagering events, the gaming system associates a plurality of different magnitudes. Each of the plurality of different magnitudes corresponds to a designated time period during the game session. For each of the plurality of different wagering events, the gaming system determines a portion of the total wager for the wagering event, determines the time period for said wagering event, selects the magnitude from the plurality of magnitudes corresponding to the determined time period, determines a wager for the wagering event by modifying the determined portion of the total wager amount by the selected magnitude, causes the wagering event to occur, displays an outcome for the wagering event, determines any award based on the determined wager and the displayed outcome, and provides any awards to the player.

In one such embodiment, the player selects to play a gangster style game with a number of different wagering events 64*a*, 64*b*, 64*c*, 64*d*, and 64*e*, as illustrated by Table shown in FIG. 7. In this embodiment, each of the plurality of different magnitudes corresponds to a particular time period in which one of the wagering events occurs during the play of the game. The gaming system divides the game into four equal time periods, or quarters 110*a*, 110*b*, 110*c* and 110*d*. In the example illustrated by FIGS. 5A to 5O, each quarter corresponds to 15 seconds of the designated time period of one minute for which the player placed a wager for a play of the gangster style game theme. If the player engages in a bank robbery wagering event 64*a* during the first quarter (i.e., during the first 15 seconds), the gaming system assigns a value of 1.0 to that wagering event. If the player engages in the bank robbery wagering event 64*a* during the second quarter, the gaming system assigns a value of 0.95 to that event, etc. In another such embodiment, instead of dividing the game into four equal time increments, the gaming system divides the game into any suitable number of equal time increments, such as halves, thirds, fifths, etc. In another such embodiment, the gaming system divides the game into any suitable number of unequal time increments.

In another embodiment, for each of the plurality of different wagering events, the gaming system associates a group (such as a range) of magnitudes with that wagering event. For each of the plurality of different wagering events, the gaming system determines a portion of the total wager for that wagering event, randomly determines a magnitude from the range of magnitudes for that wagering event, determines a wager for that wagering event by modifying the determined portion of the total wager by the randomly determined magnitude. The gaming system then causes the wagering event to occur, displays an outcome for that wagering event, and determines any awards based on the displayed outcome and the determined wager, and provides any awards to the player.

In one such embodiment, the player selects to play a gangster style game theme, as illustrated by, Table 96 shown in FIG. 8. The gaming system associates a range of magnitudes between: (i) 1.0 to 0.9 for the bank robbery wagering event 64*a*; (ii) 0.9 to 0.8 for the jewelry store robbery wagering event 64*b*; (iii) 0.85 to 0.75 for the rob bootleggers wagering event 64*c*; (iv) 0.7 to 0.5 for the car theft wagering event 64*d*; and (v) 0.2 to 0.15 for the mugging wagering event 64*e*. If the avatar engages in the bank robbery event 64*a*, the gaming system randomly selects a magnitude from the range of 1.0 and 0.9. If the avatar engages in the jewelry store robbery wagering event 64*b*, the gaming system randomly selects a magnitude from the range of 0.9 to 0.8, etc.

In various embodiments, the gaming system is configured to provide a game session with a plurality of different sets of magnitudes such as a first set of magnitudes and different second set of magnitudes. For each of the plurality of different wagering events, the gaming system associates one of the sets of magnitudes with those wagering events. The gaming system determines or effects which of the plurality of sets of magnitudes are associated with each of the plurality of different wagering events in various manners. In one such embodiment, the gaming system enables the player to make one or more sub-selections (or the gaming system makes sub-selections) for the avatar that will be employed in a particular game theme. The gaming system effects the magnitudes associated with each of the plurality of different wagering events based on the sub-selections. For example, in the gangster style game theme, the gaming system may enable the player to select the type of weapon the gangster employs in the wagering events, such as an assault rifle, a pistol, or a knife. If the player makes a sub-selection to employ a knife, the gaming system may associate a larger set of magnitudes with each of the plurality of wagering events because the knife is a less effective weapon.

In various embodiments, the gaming system is configured to enable the player to make sub-selections which effect the average expected payout for each wagering event during the game session (i.e., the probability of determining a successful outcome for each of the wagering events). For example, in the gangster style game theme, the gaming system enables the player to select the type of weapon the gangster employs in wagering events, such as an assault rifle, a pistol or knife. If the player makes a sub-selection to employ an assault rifle, the gaming system determines or associates a higher average expected payout with each wagering event in that game session (i.e., increases the probability of determining a successful outcome for each wagering event such as successfully robbing the bank). It should be appreciated that because the gaming system increases the average expected payout for each wagering events based on the player's sub-selection, the gaming system also increases the average expected payout for that game session.

In another embodiment, the gaming system determines or effects which of the plurality of different sets of magnitudes are associated with each of the plurality of wagering events based on the total wager amount received for the game session. For example, the gaming system may associate a set of magnitudes with higher values with each of the plurality of wagering events if it receives a large total wager amount. It should be appreciated that the manner in which the gaming system determines or effects which set of magnitudes will be associated with each of the plurality of wagering events also effects the determined awards, if any, for each of the plurality of wagering events.

In various embodiments, for each game session, the gaming system associates an average expected payout with that game session and an average expected payout with each wagering event in that game session. The gaming system effects, or sets, the magnitudes associated with each of the wagering events based on the average expected payout for that game session. For example, in one embodiment, the gaming system is configured to provide a game session with five different wagering events. The gaming system associates an average expected payout of 200 credits with that game session and an average expected payout of 40 credits with each of the five different wagering events. Thus, the gaming system sets the magnitudes associated with each of the five wagering events such that the average expected payout for each wagering event is 40 credits.

In other embodiments, the gaming system determines, at least in part, a wager for one or more wagering events by modifying the determined portion of the total wager by the magnitude associated with the wagering event in accordance with any suitable predefined function. For example, in one embodiment, the gaming system determines, a wager for one or more of the wagering events by adding the determined portion of the total wager to the event magnitude.

In the embodiment illustrated by FIGS. 5A to 5O, the gaming system determines the same portion of the total wager because the amount of time that transpired since the previous wagering event or the beginning of the game session is the same (i.e., 10 seconds). In different embodiments, the amount of time that transpires between one or more wagering events or since the beginning of the game session is different, thus the determination of the total wager amount for one or more wagering events is different.

In one embodiment, for one or more of the wagering events, instead of the gaming system determining the wager for that wagering event by modifying the determined portion of the total wager amount, the gaming system determines whether the player has a predetermined number of wagering credits. If the player has the predetermined number of wagering credits, the gaming system determines the wager amount for that wagering event based on the predetermined number of credits. For example, for one or more of the wagering events, if the predetermined number of credits is 100 credits and the player has a total number of wagering credits of 120 credits, then the gaming system determines a wager amount of 100 credits for that wagering event. If the player does not have the predetermined number of 100 credits, the gaming system modifies the determined portion of the total wager amount according to any of the other embodiments disclosed herein.

In another embodiment, the gaming system determines the total wager amount and/or the amount of time for a game session in different manners. In one embodiment, for each of the selectable wagering options 46 (e.g. in the embodiment illustrated FIGS. 5A to 5O), the gaming system assigns any suitable number of wagering credits for a particular game session and any suitable period of time for the game session. In another embodiment, the gaming system enables the player to input a particular wager amount that corresponds to a designated period of time for a game session. For example, instead of the gaming system displaying selectable wagering options 46, as shown in FIG. 5A, the gaming system requests that the player input a designated total wager amount for a game session and then assigns an amount of time for the game session based at least in part on the player inputted amount. In an alternative embodiment, the gaming system may request that the player input the total amount of time for the game session and then assign a designated number of credits needed for the game session for the inputted amount of time. In various alternative embodiments, the amount of time assigned to a game session and/or the amount of credits assigned to a particular game session is randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

It should be appreciated that in the example embodiment illustrated by FIGS. 5A to 5O, the gaming system determines an outcome for each wagering event based on one or more player inputs requiring skill. In these embodiments, the gaming system is more likely to determine a successful outcome for each wagering event (such as a points outcome associated with an award of a number of points), if a player is more skillful. It should be appreciated that in other embodiments, the gaming system does not determine an outcome based on one or more inputs requiring skill by a player.

In various other embodiments, for each wagering event, instead of the gaming system determining an award in terms of a number of credits and providing the determined number of credits separately from the total number of wagering credits (such as in the credits won display), the gaming system is configured to automatically add the determined number of credits to the total number of wagering credits for the game session.

In another embodiment, at the end of the designated period of time, the gaming system automatically wagers the total number of credits earned during the play of the game and provides an award to the player in accordance with a predefined paytable. In various other embodiments, at the end of the designated time period, the gaming system enables the player to automatically elect to play another game session in which at least a portion of the total number of credits won are converted into wagering credits for an additional period of time to play another game session.

In various embodiments, the awards for any of the embodiments described herein could be any one of: (i) a number of credits; (ii) a number of free games; (iii) a number of activations or play of a bonus game or secondary game; (iv) a number of selections for a game; (v) player tracking points; (vi) money, or (vii) any combination thereof.

In various embodiments, the gaming system disclosed is configured to provide a game session as a wagering primary game base game. In another embodiment, the gaming system disclosed herein is configured to provide a game session as a secondary or bonus game wherein the initial wager is provided by the gaming system.

It should be understood that various changes and modifications to the presently preferred embodiments described herein will be apparent to those skilled in the art. Such changes and modifications can be made without departing from the spirit and scope of the present disclosure and without diminishing, its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive a total wager for a game session over a designated period of time, said game session including a plurality of different wagering events, each of a plurality of the different wagering events associated with one of a plurality of different magnitudes; and (b) for each of the plurality of different wagering events:

(i) determine a portion of the total wager for said wagering event, (ii) determine a wager for said wagering event by modifying the determined portion of the total wager by the magnitude associated with said wagering event, (iii) cause said wagering event to occur, (iv) determine at least one outcome for said wagering event, (v) determine any awards for said wagering event based at least in part on the determined wager and the at least one determined outcome, and (vi) provide any determined awards.

2. The gaming system of claim 1, wherein the determination of the portion of the total wager for said wagering event is based on one of: (a) an amount of time since a previous wagering event during the game session, and (b) an amount of time since the beginning of the game session.

3. The gaming system of claim 1, wherein when executed by the at least one processor, the plurality of instructions cause the at least one processor to operate with the at least one display device and the at least one input device to, for each of the plurality of wagering events, randomly determine said at least one outcome and determine any awards based on the randomly determined outcome and the determined wager.

4. The gaming system of claim 1, wherein when executed by the at least one processor, the plurality of instructions cause the at least one processor to operate with the at least one display device and the at least one input device to, for each of the plurality of wagering events, determine said at least one outcome based at least in part on a player's skill.

5. The gaming system of claim 1, wherein each of the plurality of different wagering events is associated with a different magnitude.

6. The gaming system of claim 1, which includes a first set of magnitudes and different second set of magnitudes, the first and second sets of magnitudes each including a plurality of different magnitudes, and wherein the plurality of different wagering events are each associated with one of the first and second sets of magnitudes.

7. The gaming system of claim 1, wherein the game session includes a game theme and each of the plurality of different wagering events is a different event in the game theme.

8. The gaming system of claim 1, wherein each of the plurality of different wagering events is one of: (i) a card game, (ii) a slot game, (iii) bingo, and (iv) keno.

9. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive a total wager for a game session over a designated period of time, said game session including a plurality of different wagering events, each of a plurality of the different wagering events associated with one of a plurality of different groups of magnitudes; and (b) for each of the plurality of different wagering events:

(i) determine a portion of the total wager for said wagering event, (ii) randomly determine a magnitude from the group of magnitudes associated with for said wagering event, (iii) determine a wager for said wagering event by modifying the determined portion of the total wager by said randomly determined magnitude, (iv) cause said wagering event to occur, (v) determine at least one outcome for said wagering event, (vi) determine any award for said wagering event based at least in part on the determined wager and the at least one determined outcome, and (vii) provide any determined award.

10. The gaming system of claim 9, wherein the determination of the portion of the total wager for said wagering event is based on one of: (a) an amount of time since a previous wagering event, and (b) an amount of time since the beginning of the game session.

11. The gaming system of claim 9, wherein when executed by the at least one processor, the plurality of instructions cause the at least one processor to operate with the at least one display device and the at least one input device to, for each of the plurality of wagering events, randomly determine said at least one outcome and determine any award based on the randomly determined outcome and the determined wager.

12. The gaming system of claim 9, wherein each of the plurality of different wagering events is associated with a different magnitude.

13. The gaming system of claim 9, which includes a first group of magnitudes and different second group of magnitudes, the first and second groups of magnitudes each including a plurality of different magnitudes, and wherein the plurality of different wagering events are each associated with one of the first and second groups of magnitudes.

14. The gaming system of claim 9, wherein the game session includes a game theme and each of the plurality of different wagering events is a different event in the game theme.

15. The gaming system of claim 9, wherein each of the plurality of different wagering events is one of: (i) a card game, (ii) a slot game, (iii) bingo, and (iv) keno.

16. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive a total wager for a game session over designated period of time, said game session including a plurality of different wagering events, each of a plurality of the different wagering events associated with one of a plurality of different magnitudes, each of the plurality of different magnitudes corresponding to a particular time period during the game session; and (b) for each of the plurality of different wagering events:

(i) determine a portion of the total wager, (ii) determine a time period for said wagering event, (iii) select the magnitude from the plurality of magnitudes corresponding to said determined time period, (iv) determine a wager for said wagering event by modifying the determined portion of the total wager by the selected magnitude, (v) cause said wagering event to occur, (vi) determine at least one outcome for said wagering event, (vii) determine any awards based at least in part on the determined wager and the at least one determined outcome, and (viii) provide any determined awards.

17. The gaming system of claim 16, wherein the determination of the portion of the total wager for said wagering event is based on one of: (a) an amount of time since a previous wagering event, and (b) an amount of time since the beginning of the game session.

18. The gaming system of claim 16, wherein when executed by the at least one processor, the plurality of instructions cause the at least one processor to operate with the at least one display device and the at least one input device to, for each of the plurality of wagering events, randomly determine said at least one outcome and determine any awards based on the randomly determined outcome and the determined wager.

19. The gaming system of claim 16, wherein each of the plurality of different wagering events is associated with a different magnitude.

* * * * *